US008525632B2

(12) United States Patent
Yamamoto

(10) Patent No.: US 8,525,632 B2
(45) Date of Patent: Sep. 3, 2013

(54) REACTOR

(75) Inventor: Shinichiro Yamamoto, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/386,848

(22) PCT Filed: Mar. 4, 2010

(86) PCT No.: PCT/JP2010/053505
§ 371 (c)(1),
(2), (4) Date: Jan. 24, 2012

(87) PCT Pub. No.: WO2011/013394
PCT Pub. Date: Feb. 3, 2011

(65) Prior Publication Data

US 2012/0119869 A1 May 17, 2012

(30) Foreign Application Priority Data

Jul. 29, 2009 (JP) ..... 2009-177062
Mar. 4, 2010 (JP) ..... 2010-047224

(51) Int. Cl.
*H01F 27/24* (2006.01)
*H01F 27/02* (2006.01)
*H01F 17/04* (2006.01)

(52) U.S. Cl.
USPC ..... 336/212; 336/83; 336/221; 336/233; 336/90

(58) Field of Classification Search
USPC ..... 336/90, 205, 212, 221, 233, 234, 336/83
See application file for complete search history.

(56) References Cited

U.S. PATENT DOCUMENTS 5,821,844 A * 10/1998 Tominaga et al. ..... 336/110
5,861,792 A * 1/1999 Ueda et al. ..... 336/234

(Continued)

FOREIGN PATENT DOCUMENTS

JP 2002-057039 A 2/2002
JP 2006-004957 A 1/2006

(Continued)

OTHER PUBLICATIONS

Notice of Reasons of Rejection, and partial English translation thereof, issued in Japanese Patent Application No. 2010-047224 dated Apr. 2, 2010.

*Primary Examiner* — Mohamad Musleh
*Assistant Examiner* — Mangtin Lian
(74) *Attorney, Agent, or Firm* — McDermott Will & Emery LLP

(57) ABSTRACT

Provided is a reactor having a small size. A reactor 1α includes a coil 2α and a magnetic core 3α in which the coil 2α is disposed. The magnetic core 3α includes an internal core portion 3*i* that is inserted through the coil 2α and a couple core portion 3*o* that covers the outer periphery of the coil 2α, and these core portions form a closed magnetic path. The reactor 1α satisfies $1<(B1/B2)$ and $0.17\times(B1/B2)+0.42\leqq(S1\times B1)/(S2\times B2)\leqq 0.50\times(B1/B2)+0.62$, where S1 is the cross-sectional area of the internal core portion, B1 is the saturation magnetic flux density of the internal core portion, S2 is the cross-sectional area of the couple core portion, B2 is the saturation magnetic flux density of the couple core portion, (B1/B2) is the saturation magnetic flux density ratio between the core portions, and (S1×B1)/(S2×B2) is the magnetic flux ratio between the core portions. The cross-sectional area of the internal core portion 3*i* can be reduced because $1<(B1/B2)$ is satisfied, and the size of the reactor 1α can be reduced because (S1×B1)/(S2×B2) is adjusted to be in a specific range.

15 Claims, 7 Drawing Sheets

(56) References Cited

U.S. PATENT DOCUMENTS

| | | | | |
|---|---|---|---|---|
| 5,926,946 | A * | 7/1999 | Minato et al. | 29/606 |
| 7,449,984 | B2 * | 11/2008 | Kawarai | 336/83 |
| 2003/0184423 | A1 * | 10/2003 | Holdahl et al. | 336/83 |
| 2008/0310051 | A1 * | 12/2008 | Yan et al. | 360/123.01 |
| 2009/0027151 | A1 * | 1/2009 | Nakatsu et al. | 336/212 |

FOREIGN PATENT DOCUMENTS

| | | | |
|---|---|---|---|
| JP | 2007-201203 | A | 8/2007 |
| JP | 2008-147403 | A | 6/2008 |
| JP | 2008-147405 | A | 6/2008 |
| JP | 2008-159832 | A | 7/2008 |
| JP | 2009-033051 | A | 2/2009 |

* cited by examiner (I)

(II)

REACTOR

RELATED APPLICATIONS

This application is the U.S. National Phase under 35 U.S.C. §371 of International Application No. PCT/JP2010/053505, filed on Mar. 4, 2010, which in turn claims the benefit of Japanese Application No. 2009-177062, filed on Jul. 29, 2009, and Japanese Application No. 2010-047224, filed on Mar. 4, 2010, the disclosures of which Applications are incorporated by reference herein.

TECHNICAL FIELD

The present invention relates to a reactor used as a component of an electric power converter such as a vehicle-mounted DC-DC converter. In particular, the present invention relates to a small reactor.

BACKGROUND ART

A reactor is a circuit component that increases or reduces a voltage. For example, a type of reactor that is used for a converter mounted on a vehicle such as a hybrid vehicle includes an annular (O-shaped) magnetic core and a pair of coils that are formed by winding a wire and arranged in parallel with each other.

PTL 1 discloses another type of reactor including a magnetic core that has an E-shaped cross section, which is a so-called pot-shaped core. The magnetic core includes a solid-cylindrical internal core portion that is disposed inside a coil, a hollow-cylindrical core portion that is disposed so as to surround the outer periphery of the coil, and a pair of disk-shaped core portions that are disposed on both end surfaces of the coil (see FIG. 1 of PTL 1). In the pot-shaped core, the internal core portion and the cylindrical core portion, which are concentrically disposed, are coupled to each other by the disk-shaped core portions, and a closed magnetic path is formed. Moreover, PTL 1 discloses that the cross-sectional area of the internal core portion can be reduced by making the saturation magnetic flux density of the internal core portion be higher than those of the hollow-cylindrical core portion and the disk-shaped core portions, and thereby a small reactor can be obtained.

CITATION LIST

Patent Literature

PTL 1: Japanese Unexamined Patent Application Publication No. 2009-033051

SUMMARY OF INVENTION

Technical Problem

It is preferable that a component that is disposed in a small space, such as a vehicle component, be small. PTL 1 discloses a magnetic core in which a plurality of segments are joined to one another using an adhesive. To further reduce the size of the reactor, it is preferable that the adhesive be omitted. As described in paragraph 0017 of PTL 1, the adhesive can be omitted by forming the entirety of a magnetic core from a powder molded product by disposing a coil in a mold together with a powder material and molding the magnetic core. Moreover, by making the saturation magnetic flux densities of parts of the magnetic core be different from each other as described above, a small reactor can be obtained.

However, a specific configuration of a small reactor that satisfies desired electromagnetic characteristics has not been sufficiently examined to date with a focus on the actually acceptable size or volume of a reactor.

An object of the present invention is to provide a small reactor. Another object of the present invention is to provide a small reactor having a high productivity.

Solution to Problem

The inventor focused on the size of the entirety of a reactor and examined conditions for reducing the size of the reactor while satisfying desired electromagnetic characteristics, and found that it is preferable that portions of the magnetic core have different saturation magnetic flux densities and that the saturation magnetic fluxes of the portions having different saturation magnetic flux densities be in a specific range. To be specific, as shown in the examples described below, the volume of the reactor was measured while changing the ratio between the saturation magnetic fluxes of these portions (hereinafter referred to as the magnetic flux ratio), and it was found that, in a range in which B1/B2 is larger than 1, the size of the reactor can be reduced if the magnetic flux ratio is in a specific range. On the basis of this finding, the present invention defines the relationship between the saturation magnetic flux densities of portions of a magnetic core inside and outside a coil and defines the relationship between the saturation magnetic fluxes of these portions.

According to the present invention, a reactor includes a coil formed by winding a wire and a magnetic core in which the coil is disposed. The magnetic core includes an internal core portion that is inserted through the coil and a couple core portion that covers at least a part of an outer periphery of the coil, and these core portions form a closed magnetic path. The reactor satisfies the following (1) and (2):

$$1<(B1/B2) \tag{1}$$

$$0.17\times(B1/B2)+0.42\leqq(S1\times B1)/(S2\times B2)\leqq 0.50\times(B1/B2)+0.62, \tag{2}$$

where S1 is a cross-sectional area of the internal core portion, B1 is a saturation magnetic flux density of the internal core portion, S2 is a cross-sectional area of the couple core portion, B2 is a saturation magnetic flux density of the couple core portion, (B1/B2) is a saturation magnetic flux density ratio between the core portions, and (S1×B1)/(S2×B2) is a magnetic flux ratio between the core portions.

In the reactor according to the present invention, the magnetic core is not made from a uniform material, and portions of the magnetic core that are disposed inside and outside the coil are made from different materials. Therefore, the magnetic characteristics of the portions of the magnetic core are different from each other. In particular, in the reactor according to the present invention, the saturation magnetic flux density of the internal core portion is higher than the saturation magnetic flux density of the couple core portion (1<(B1/B2)). Therefore, as compared with a magnetic core made from a uniform material, the same level of magnetic flux density can be obtained even if the cross-sectional area of the internal core portion is smaller. Moreover, the reactor according to the present invention is obtained by adjusting the saturation magnetic fluxes ((S1×B1), (S2×B2)) of the portions that are disposed inside and outside of the coil to be in a specific range, and the ratio between the saturation magnetic fluxes of the portions of the magnetic core (the magnetic flux ratio) satisfies a specific condition as described above. Thus, because the size of the internal core portion is reduced and the saturation magnetic flux ratio between the portions of the magnetic core inside and outside the coil has a specific value, the size of the reactor according to the present invention can be reduced both two-dimensionally and three-dimensionally.

Because the saturation magnetic flux density ratio (B1/B2) is larger than 1, as compared with a case where B1/B2≦1, the same amount of magnetic flux can be obtained even if the cross-sectional area of the internal core portion is small. Therefore, the outside diameter of the coil disposed on the outer periphery of the internal core portion can be reduced, and thereby the size of the reactor can be reduced. Moreover, because the outside diameter of the coil can be reduced, the length of the coil can be reduced, the resistance of the coil can be reduced, and thereby the loss can be reduced. With consideration of the reductions in the size of the coil and the loss, it is preferable that (B1/B2) be larger, with no particular upper limit. However, in order to increase B1/B2 while maintaining the saturation magnetic flux density B1 of the internal core portion constant, it is necessary to decrease B2. As a result, in particular, the volume of the couple core portion increases, and the volume of the entire reactor increases. Therefore, it is preferable that B1/B2 have any value larger than 1 as long as the volume of the reactor is not increased. For example, when the internal core portion is made from a material having a saturation magnetic flux density lower than about 2.4 T, if B1/B2 is equal to or smaller than 3, increase in the volume of the couple core portion can be prevented and the volume of the entire reactor can be reduced. In general, B1 and B2 depend on the materials of the internal core portion and the couple core portion. Therefore, the materials of the core portions may be selected so that 1<(B1/B2) is satisfied.

The cross-sectional areas S1 and S2 of the core portions are those of portions that form a magnetic path when the coil is excited. Typically, the cross-sectional area S1 of the internal core portion is the area of a cross-section of a portion the magnetic core disposed inside the coil cut along a plane perpendicular the axial direction of the coil. When only one coil is used, the cross-sectional area S2 of the couple core portion is the area of a portion of the magnetic core that is disposed outside the coil. When a pair of coil elements are used, the cross-sectional area S2 is the area of a portion of the magnetic core that couples both internal core portions, which are disposed inside the coil, to each other in an annular shape.

As an embodiment of the present invention, the couple core portion may have a magnetic permeability lower than that of the internal core portion, and the couple core portion may be made from a mixture of a magnetic material and a resin.

There is a correlation between the saturation magnetic flux density and the relative magnetic permeability of a magnetic material used for a magnetic core of a reactor. Usually, the higher the saturation magnetic flux density, the higher the relative magnetic permeability. Therefore, when the saturation magnetic flux density of the entire magnetic core is high, the relative magnetic permeability tends to become excessively high. Thus, it is necessary to provide a gap in the magnetic core, such as an air gap or a gap member made from a material having a magnetic permeability lower than that of the magnetic core, which is typically a non-magnetic material. Here, when the magnetic core has an ordinary gap, if a coil is disposed near the gap, leakage flux from the gap influences the coil and causes a loss. Therefore, when a magnetic core having an ordinary gap is used, it is necessary to provide a certain space between the inner peripheral surface of the coil and the outer peripheral surface of the internal core portion in order to reduce the loss. Reduction in the size of the reactor is limited due to the presence of the gap member and the space. Therefore, to make a small reactor, a configuration that does not have an ordinary gap, which is a so-called gapless structure, is preferable. In contrast, the relative magnetic permeability of the entire magnetic core can be adjusted by reducing the relative magnetic permeability of one of the internal core portion and the couple core portion, and thereby a gapless structure can be realized. In order to increase the saturation magnetic flux density of the internal core portion as described above, the present invention proposes a configuration in which the relative magnetic permeability of the couple core portion is lower than that of the internal core portion. By using the gapless structure, the loss does not occur even if the inner peripheral surface of the coil is disposed close to the outer peripheral surface of the internal core portion. Therefore, the size of the reactor according to the embodiment can be further reduced by disposing the internal core portion and the coil close to each other and thereby reducing, or more preferably eliminating a space between the coil and the internal core portion.

In particular, because the material of a portion of the magnetic core disposed outside the coil (couple core portion) is a specific material (a mixture of a magnetic material and a resin) in the embodiment, the magnetic characteristics can be easily changed by adjusting the ratio of the magnetic material to the resin. Therefore, with the embodiment, the inductance of a reactor can be easily adjusted and a predetermined sufficient level of inductance can be provided to the reactor.

In the embodiment, the internal core portion and the couple core portion may be integrated with each other through the resin included in the couple core portion. In this case, an ordinary gap such as a gap member does not exist and an adhesive for joining segments of the magnetic core or for joining the segments and the gap member does not exist, and thereby the size of the reactor can be further reduced. Moreover, a magnetic core having predetermined characteristics can be formed and a reactor can be manufactured by integrating the internal core portion and the couple core portion with each other through the resin material, or typically, by forming the couple core portion so as to cover the assembly including the coil and the internal core portion. Thus, forming of the couple core portion, forming of the magnetic core, and manufacturing of the reactor can be simultaneously performed. Moreover, when magnetic core has a so-called gapless structure as described above, the number of components and the number of manufacturing steps can be reduced. Here, if the magnetic core is formed by joining a plurality of segments by using an adhesive as described above, the number of components and the number of manufacturing steps increase, and thereby productivity of the reactor decreases. When forming a magnetic core including portions having different saturation magnetic flux densities from a powder molded product, it is necessary to perform multiple pressing steps if the magnetic core has a certain shape, and thereby the productivity of the reactor may decrease. In contrast, a reactor according to the embodiment has a high productivity. Moreover, because the internal core portion and the couple core portion, which are independent members, are integrated with each other through the resin material of the couple core portion, the core portion can have desired characteristics with high precision.

As an embodiment of the present invention, the number of the coils formed by winding the wire may be one.

A reactor according to the present invention may have a coil including a pair of coil elements that are disposed side by side so that the axial directions of the coil elements are parallel to each other. In contrast, a pot-shaped configuration having only one coil and a so-called pot-shaped core (typically, a core having an E-I shaped cross section or an E-E shaped cross section) can be easily made smaller than the configuration having a plurality of coil elements. In particular, when the coil is a hollow-cylindrical body and the internal core portion is a solid-cylindrical body having a shape that follows the outer shape of the coil, a space between the outer peripheral surface of the internal core portion and the inner peripheral surface of the coil can be reduced, and thereby the size of the reactor can be further reduced.

As an embodiment of the present invention, the internal core portion may be made from a powder molded product, and the couple core portion may be made from a mixture of an iron-based material and a resin.

As the material of the internal core portion included in the reactor according to the present invention, a material having a saturation magnetic flux density higher than that of the couple core portion is used. Because the couple core portion in the embodiment includes a resin, which is usually a non-magnetic material, a powder molded product can be preferably used as a material having a saturation magnetic flux density higher than that of the couple core portion. Because a powder molded product having a three-dimensional shape can be easily formed, for example, an internal core portion having an outer shape that follows the shape of the inner peripheral surface of the coil can be easily formed. If the outer shape of the internal core portion is similar to the shape of the inner peripheral surface of the coil, the inner peripheral surface of the coil can be disposed close to the outer peripheral surface of the internal core portion, and thereby the size of the reactor can be further reduced.

In general, an iron-based material, such as Fe (pure iron) and an Fe-based alloy, has a saturation magnetic flux density higher than that of a magnetic material such as ferrite. Therefore, a magnetic core having a high saturation magnetic flux density can be made from an iron-based material. Because the material of the couple core portion in this embodiment is a mixture of an iron-based material and a resin, a magnetic core having desired magnetic characteristics can be easily made by adjusting the proportion of the resin.

As an embodiment of the present invention, the reactor may further include an internal resin portion that is made from an insulating resin, that covers a surface of the coil, and that retains a shape of the coil.

The coil is typically formed by winding a wire that includes a conductor made from a conductive material such as copper and an insulation coating that is made from an insulating material such as an enamel and that is disposed on the outer periphery of the conductor. When the coil is made from a wire having an insulation coating, the coil and the magnetic core can be insulated from each other by the insulation coating. In addition, by covering the coil with an insulation resin as described above, insulation between the coil and the magnetic core can be further increased. Moreover, with the configuration described above, the shape of the coil is retained by the internal resin portion. Therefore, when manufacturing the reactor, for example, when placing an assembly including the coil and the couple core portion in a mold for forming the couple core portion, the coil does not extend or contract. As a result, the coil can be handled easily, and the reactor has a high productivity. The coil can be retained in a compressed state by the internal resin portion. By appropriately compressing the coil, the length of the coil in the axial direction is reduced, and the size of the reactor can be reduced.

As an embodiment of the present invention, in the case where the reactor includes the internal resin portion, the internal core portion may be retained by the internal resin portion so as to be integrated with the coil.

With this configuration, the coil and the internal core portion are integrated with each other through the internal resin portion, so that the coil and the internal core portion can be handled as a unit. Therefore, for example, the coil and the internal core portion can be easily placed in a mold for forming the couple core portion, and the reactor has a high productivity. Moreover, the coil and the internal core portion can be integrated with each other simultaneously with molding the internal resin portion, the reactor has a high productivity also in this respect. Furthermore, if the coil and the internal core portion are not integrated with each other with the internal resin portion and used as independent members, it is necessary to form a hollow bore for inserting the internal core portion thereinto in the internal resin portion. In this case, it is necessary to provide a certain space between the internal core portion and the hollow bore with consideration of the insertability of the internal core portion. In contrast, when the coil and the internal core portion are integrated with each other through the internal resin portion, there is substantially only the internal resin portion between the inner peripheral surface of the coil and the internal core portion. As a result, the size of the reactor can be reduced by the volume of the space.

As an embodiment of the present invention, the wire of the coil has a flat shape with a cross section having an aspect ratio that is equal to or higher than 5, and the number of turns of the coil may be in the range of 30 to 60.

A coil having a small volume can be formed from such a flat wire, and the size of the coil can be reduced. When the size of the coil is reduced, the size of the reactor according to the present invention can be reduced. It is preferable that the aspect ratio be 1.5 or higher, more preferably be 5 or higher as described above, in particular be 8 or higher, and more preferably be 10 or higher. However, it is difficult to form a coil if the aspect ratio is too high. Therefore, an aspect ratio in the range of about 10 to 20 may be appropriate. A typical flat wire is a wire including a rectangular conducting wire (whose aspect ratio is width/thickness). When the aspect ratio is in this range and the number of turns is in the range described above, a small coil can have a predetermined inductance required for a vehicle-mounted converter. In the embodiment including a plurality of coils, if the total number of turns is in the range described above, the reactor can be preferably used as a vehicle component as described above.

As an embodiment of the present invention, a flatness $3\times L1/(L1+L2+L3)$ of the smallest rectangular parallelepiped that is capable of containing an assembly including the coil and the magnetic core may be equal to or larger than 0.5, where L1, L2, and L3 are dimensions of the rectangular parallelepiped in ascending order of length.

With this embodiment, the reactor has a small footprint, a small volume, and a small size. When the flatness is close to 1.0, that is, when the assembly is substantially cubic, the footprint and the volume can be minimized.

As an embodiment of the present invention, the saturation magnetic flux density B1 of the internal core portion may satisfy $1.6\ T \leqq B1$ and $1.2\times B2 \leqq B1$.

Because the saturation magnetic flux density B1 of the internal core portion is equal to or higher than 1.2 times the saturation magnetic flux density B2 of the couple core portion, the internal core portion has a relatively sufficiently high saturation magnetic flux density, and thereby the cross-sectional area of the internal core portion can be reduced. Therefore, the reactor according to this embodiment is small. In particular, it is preferable that the saturation magnetic flux density B1 of the internal core portion be equal to or higher than 1.5 times and more preferably be equal to or higher than 1.8 times the saturation magnetic flux density B2 of the couple core portion with no upper limit. It is preferable that the saturation magnetic flux density B1 (absolute value) of the internal core portion be as high as possible. It is preferable that B1 be equal to or higher than 1.8 T and more preferably be equal to or higher than 2 T with no upper limit. The materials of the internal core portion and the couple core portion may be adjusted so that the saturation magnetic flux densities may be in the range described above.

As an embodiment of the present invention, the magnetic permeability of the internal core portion may be in the range of 50 to 1000, and the magnetic permeability of the couple core portion may be in the range of 5 to 50.

With the embodiment, leakage flux from the magnetic core can be reduced, and a gapless structure is realized. A reactor according to the present invention can be easily used as a vehicle component if the couple core portion has a magnetic permeability in the range of about 5 to 30 and the internal core portion has a magnetic permeability in the range of about 100 to 500. The materials of the internal core portion and the couple core portion may be adjusted so that the magnetic permeabilities may be in the range described above.

As an embodiment of the present invention, the couple core portion may include an attachment portion for fixing the reactor to a mount object.

In general, a reactor is used after being mounted on a mount object, such as a cooling base in which a coolant is circulated, using a fastener such as a bolt. When the couple core portion includes the attachment portion, an attachment member such as a stay for supporting the bolt or the like is not necessary, and therefore the number of components can be reduced. Moreover, when the couple core portion includes the attachment portion, the magnetic core can be directly fixed to the mount object. In particular, with this embodiment, if the couple core portion is made from a mixture of a magnetic material and a resin as described above, the attachment portion for supporting the bolt or the like can be easily formed in the couple core portion because the couple core portion includes the resin. This attachment portion can be formed from the resin simultaneously with forming the couple core portion, so that the reactor has a high productivity.

As an embodiment of the present invention, the reactor may further include an external resin portion that covers at least a part of an outer periphery of an assembly including the coil and the magnetic core.

When the reactor has the external resin portion, the assembly including the internal core portion and the couple core portion, which is disposed on the outer periphery of the coil, can be sufficiently protected by the external resin portion. In particular, if the couple core portion includes a resin as described above, the coil and the internal core portion can be protected against the external environment and mechanically protected by the resin. Therefore, with the embodiment including the external resin portion, the assembly can be more reliably protected.

As an embodiment of the present invention, the reactor may further include a case that contains an assembly including the coil and the magnetic core. In this case, the couple core portion may be made from a mixture of a magnetic material and a resin, and the coil and the internal core portion may be sealed in the case by the resin included in the couple core portion.

As described above, the assembly including the coil and the magnetic core may be protected against the external environment and mechanically protected by the external resin portion as described above. However, the protection can be secured by disposing the assembly in the case. With this configuration, it is not necessary to prepare an additional potting resin because the resin material of the couple core portion is used as a sealing resin.

As an embodiment of the present invention, the internal core portion may be made from a laminated structure of magnetic steel plates.

By using magnetic steel plates, an internal core portion having a saturation magnetic flux density higher than that of a powder molded product described above can be easily obtained.

Advantageous Effects of Invention

A reactor according to the present invention is small.

BRIEF DESCRIPTION OF DRAWINGS

FIG. 4(A) is a perspective view, and FIG. 4(B) is a plan view of the reactor in which a part of a couple core portion is cut.

FIG. 6(A) is a perspective view, and FIG. 6(B) is an exploded perspective view.

DESCRIPTION OF EMBODIMENTS

Figure 1:
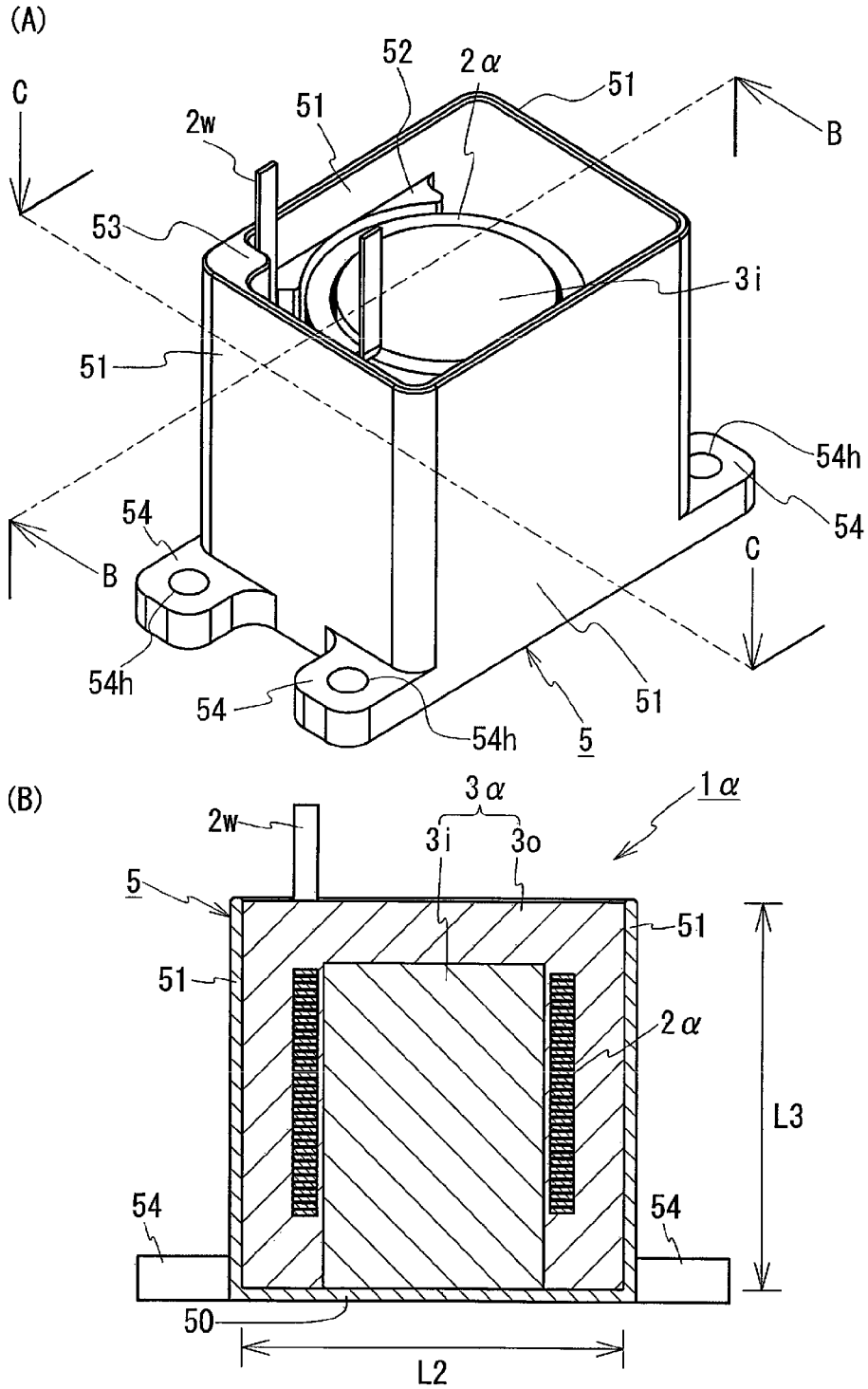
FIG. 1(A) is a schematic perspective view of a reactor according to a first embodiment.
FIG. 1(B) is a sectional view taken along line B-B of FIG. 1(A).

Hereinafter, reactors according to embodiments will be described with reference to the drawings. The actual structure will be described first, and then the magnetic flux ratio will be described. The same numerals in the drawings denote the same objects. For ease of understanding, ends of a wire and a joint portion between coil elements are not illustrated in FIGS. 4 and 5.

First Embodiment

Figure 2:
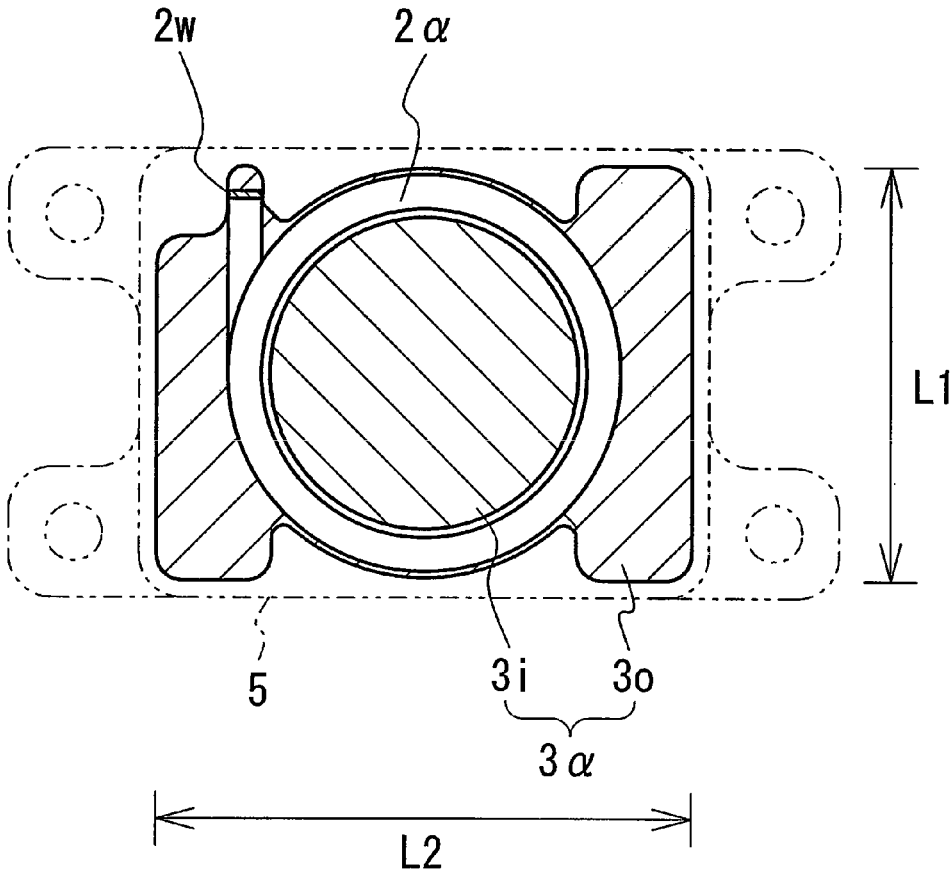
FIG. 2 is a sectional view of the reactor according to the first embodiment taken along line C-C of FIG. 1(A).
Figure 3:
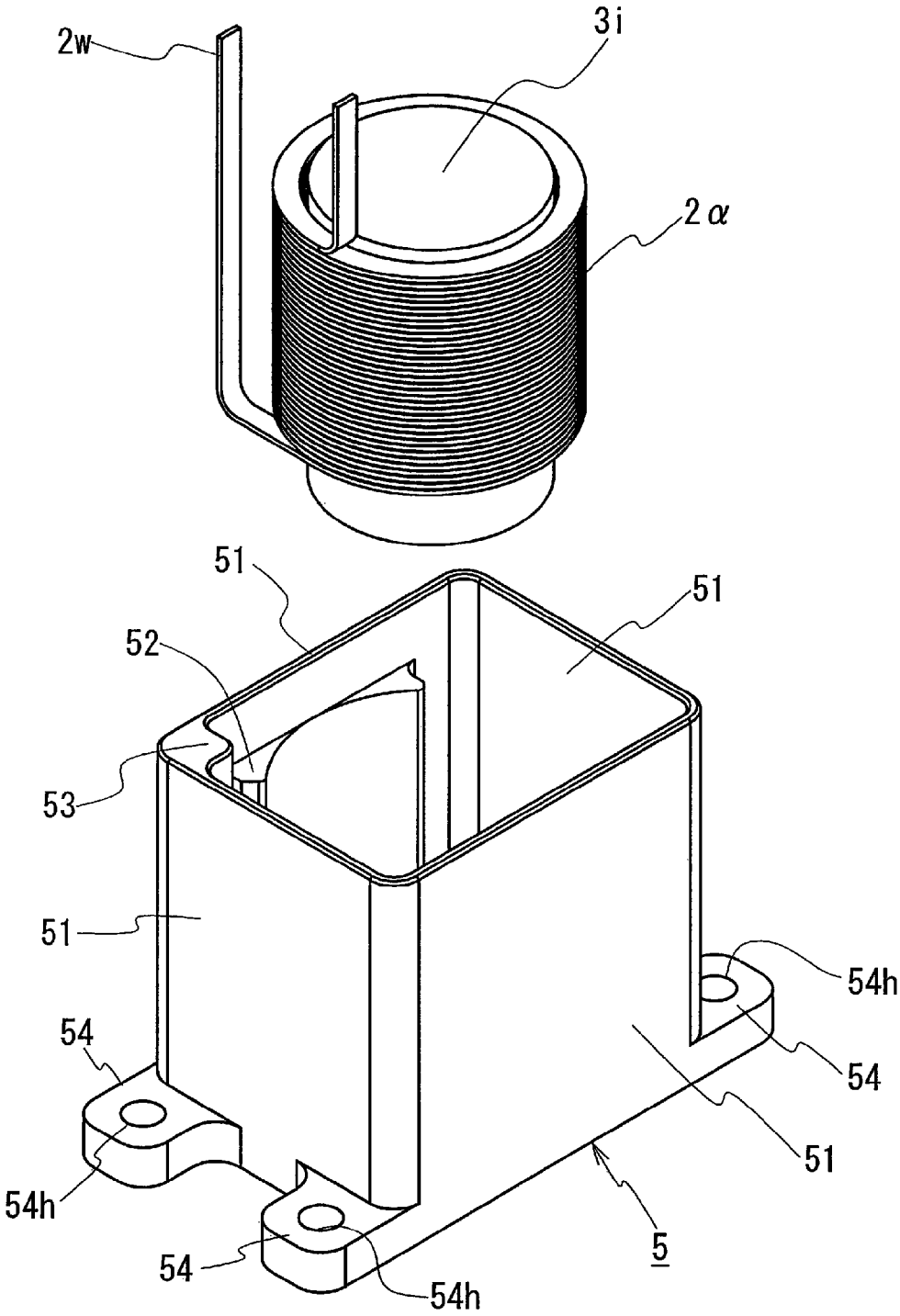
FIG. 3 is a schematic exploded view illustrating components of the reactor according to the first embodiment.

Referring mainly to FIGS. 1 to 3, a reactor 1α according to a first embodiment will be described. The reactor 1α, which is a so-called pot-shaped reactor, includes a coil 2α that is formed by winding a wire 2*w* and a magnetic core 3α in which the coil 2α is disposed. The magnetic core 3α includes an internal core portion 3*i* that is inserted through the coil 2α and a couple core portion 3*o* that covers substantially the entire periphery of the coil 2α. The internal core portion 3*i* and the couple core portion 3*o* are coupled to each other. These core portions 3*i* and 3*o* form a closed magnetic path. The reactor 1α, is characterized by the material, the configuration, and the electromagnetic characteristics of the magnetic core 3α. Hereinafter, components will be described in detail.

[Coil 2α]

The coil 2α is a cylindrical body that is made by helically winding a single continuous wire. It is preferable that the wire 2*w* be an insulated wire, which includes a conductor coated with an insulation coating. The conductor is made from a conducting material such as copper or aluminium, and the insulation coating is made from an insulating material. Here, an insulated rectangular wire, which includes a rectangular copper conductor wire and an insulation coating made from an enamel, is used. The aspect ratio (width/thickness) of the cross section of the rectangular wire is 11, which is equal to or higher than 10. The insulating material of the insulation coating is typically a polyamidoimide. It is preferable that the thickness of the insulation coating be in the range of 20 μm to 100 μm. The thicker, the smaller the number of pin holes and the higher the insulation. The coil 2α is made by winding the insulated rectangular wire edgewise. An edgewise-wound coil can be made comparatively easily when the coil has a cylindrical shape. Here, the number of turns of the coil 2α is 46, which is in the range of 30 to 60. (The numbers of turns illustrated in FIGS. 1 and 3 are examples.) Instead of a wire including a rectangular conductor, various wires including a conductor having circular cross section, polygonal cross section, and the like can be used.

Both ends of the wire 2*w* of the coil 2α are appropriately drawn out from the turn portion to the outside of the couple core portion 3*o* described below. Terminal members (not shown), which are made from a conducting material such as copper or aluminium, are connected to conductor portions, which have been exposed by stripping off the insulation coating. An external apparatus (not shown) for supplying electric power to the coil 2α, such as an electric power supply, is connected to the coil 2α via the terminal members. The conductor portions of the wire 2*w* and the terminal members are connected to each other by welding such as TIG welding or by crimping. In the example illustrated in FIG. 1, the ends of the wire 2*w* are drawn out in a direction parallel to the axial direction of the coil 2α. However, the ends may be drawn out in any appropriate direction. For example, the ends of the wire may be drawn out in a direction that is perpendicular to the axial direction of the coil 2α, or may be drawn out in directions different from each other. This configuration of the wire and the coil can be used in other embodiments described below.

[Magnetic Core 3α]

The magnetic core 3α includes a cylindrical internal core portion 3*i* and a couple core portion 3*o*. The internal core portion 3*i* is inserted through the coil 2α. The couple core portion 3*o* is formed so as to cover one of the circular end surfaces and the cylindrical outer surface of the internal core portion 3*i*. In particular, in the magnetic core 3α, the internal core portion 3*i* and the couple core portion 3*o* have different magnetic characteristics because the internal core portion 3*i* and the couple core portion 3*o* are made from different materials. To be specific, the internal core portion 3*i* has a saturation magnetic flux density higher than that of the couple core portion 3*o*, and the couple core portion 3*o* has a magnetic permeability lower than that of the internal core portion 3*i*.

<<Internal Core Portion>>

The internal core portion 3*i* has a cylindrical outer shape that follows the shape of the inner peripheral surface of the coil 2α, and the entirety of the internal core portion 3*i* is made from a powder molded product. Here, the internal core portion 3*i* is a solid body in which a gap member, an air gap, and an adhesive are not present.

Typically, a powder molded product is obtained by molding soft magnetic powder having an insulation coating, and then baking the molded product at a temperature that is equal to or lower than the upper limit temperature of the insulation coating. Instead of the soft magnetic powder, mixture powder including the soft magnetic powder and an appropriate amount of binder may be used, or powder including a silicone resin as the insulation coating may be used. The saturation magnetic flux density of powder molded product can be changed by adjusting the material of the soft magnetic powder, the mixture ratio of the soft magnetic powder to the binder, and the amounts of various coatings. For example, a powder molded product having a high saturation magnetic flux density can be obtained from soft magnetic powder having a high saturation magnetic flux density or by reducing the amount of binder and increasing the proportion of the soft magnetic material. Moreover, the saturation magnetic flux density can be increased by changing the molding pressure, or to be specific, by increasing the molding pressure. It is preferable that the material of the soft magnetic powder be selected and the molding pressure be adjusted so that the powder molded product may have a desired saturation magnetic flux density.

The soft magnetic powder may be powder of an iron group metal such as Fe, Co, or Ni; powder of an iron-based alloy such as Fe—Si, Fe—Ni, Fe—Al, Fe—Co, Fe—Cr, Fe—Si—Al, or the like; or powder of a rare-earth metal; or ferrite powder. In particular, a powder molded product having a high saturation magnetic flux density can be easily made from powder of an iron-based alloy. Such powder can be produced by an atomization method (using gas or water) or a mechanical pulverization method. A powder molded product having a high anisotropy and a low coercive force can be obtained from powder made from a nanocrystalline material having a nanosized crystalline structure. The insulation coating formed on the soft magnetic powder may be made from, for example, a phosphate compound, a silicon compound, a zirconium compound, an aluminium compound, or a boron compound. The binder is, for example, a thermoplastic resin, a non-thermoplastic resin, or a higher fatty acid. The binder may be eliminated or changed into an insulator such as silica in the baking step. Because a powder molded product includes an insulator such as an insulation coating, soft magnetic particles are insulated from one another, and therefore eddy-current loss can be reduced. In particular, the loss can be reduced even if high-frequency electric power is supplied to the coil. As the powder molded product, a powder molded product of a known type may be used. For example, a powder molded product including particles made from the soft magnetic material that are coated with a multilayer coating that sequentially includes the insulation coating, a heat resistant layer, and a flexible layer may be used (such a soft magnetic material is described in Japanese Unexamined Patent Application Publication No. 2006-202956). Examples of the heat resistant layer include a layer made from a material that includes an organic silicon compound and that has a siloxane cross-linking density higher than 0 and equal to or lower than 1.5. Examples of the flexible layer include a layer made from at least one of a silicone resin, an epoxy resin, a phenolic resin, and an amide resin.

Here, the internal core portion 3*i* is made from a powder molded product including the soft magnetic material having the multi-layered coating described above. The saturation magnetic flux density B1 of the internal core portion 3*i* is equal to or higher than 1.6 T (1.6 T≦B1) and equal to or higher than 1.2 times the saturation magnetic flux density B2 of the couple core portion 3*o* (1.2×B2≦B1, i.e., 1<1.2≦(B1/B2)). The relative magnetic permeability of the internal core portion 3*i* is in the range of 100 to 500. Here, B1=1.8 T, B2=1 T, (B1/B2)=1.8, and the relative magnetic permeability is 250.

In the example illustrated in FIG. 1, the length of the internal core portion 3*i* in the axial direction of the coil 2α

(hereinafter, simply referred to as the length) is larger than the length of the coil 2α, and both end surfaces of the internal core portion 3*i* and the vicinities thereof protrude from end surfaces of the coil 2α. In this example, the end surfaces of the internal core portion 3*i* protrude from the end surfaces of the coil 2α by different protruding lengths. As illustrated in FIG. 1, one end surface located near a bottom surface 50 of a case 5 protrudes by a larger length. The protruding lengths may be appropriately selected. The length of the internal core portion 3*i* may be the same as or slightly shorter than that of the coil 2α. If the length of the internal core portion 3*i* is equal to or larger than that of the coil 2α, magnetic flux generated by the coil 2α can sufficiently pass through the internal core portion 3*i*. In the example illustrated in FIG. 1, the internal core portion 3*i* is disposed in such a way that an end surface of the internal core portion 3*i* is in contact with the bottom surface 50 of the case 5 and faces in a direction toward the mount object when the reactor 1α is mounted on a mount object. In this case, the internal core portion 3*i* can be stably disposed in the case 5, and therefore the couple core portion 3*o* can be easily formed.

<<Couple Core Portion>>

The couple core portion 3*o* illustrated in FIG. 1 is formed so as to cover substantially the entirety of the end surfaces and the outer peripheral surface of the coil 2α and so as to cover the outer peripheral surface of the internal core portion 3*i* and an end surface of the internal core portion 3*i* that is not in contact with the case 5. The couple core portion 3*o* and the internal core portion 3*i* of the magnetic core 3α form a closed magnetic path. The couple core portion 3*o* and the internal core portion 3*i* are joined to each other without using an adhesive but through the resin material of the couple core portion 3*o*. Therefore, the magnetic core 3α is an integrated body, the entirety of which is integrated without using an adhesive or a gap member.

Here, the couple core portion 3*o* is a rectangular parallelepiped that covers the entirety of the coil 2α. However, the shape of the couple core portion is not particularly limited as long as a closed magnetic path can be formed. For example, a configuration in which at least a part of the outer periphery of the coil 2α is not covered by the couple core portion and exposed to the outside may be used. To be specific, examples of such a configuration of the couple core portion include a U-I type having a U-shaped cross section and an E-E type formed by combining E-shaped cores. The couple core portion may be formed so as to have a desired shape.

Here, the entirety of the couple core portion 3*o* is made from a mixture of a magnetic material and a resin (hardened molded product). Typically, a hardened molded product can be made by performing injection molding or cast molding.

In the case of injection molding, powder of a magnetic material (if necessary, mixture powder that further includes non-magnetic powder) and a fluid binder resin are mixed with each other to obtain a mixture fluid, the mixture fluid is injected into a mold and molded while applying a predetermined pressure, and then the binder resin is hardened. In the case of cast molding, a mixture fluid the same as that of injection molding is obtained, the mixture fluid is injected into a mold and molded without applying a pressure, and then the mixture fluid is hardened.

In either molding method, soft magnetic powder that is the same as that used for the internal core portion 3*i* may be used as a magnetic material. In particular, as the soft magnetic powder for the couple core portion 3*o*, an iron-based material such as pure iron powder or an iron-based alloy powder composed of particles having an average diameter in the range of 10 μm to 500 μm may be preferably used. Coated powder composed of particles that are made from a soft magnetic material and that are coated with a coating made from ferric phosphate or the like may be used.

In either molding method, a thermosetting resin such as an epoxy resin, a phenolic resin, or a silicone resin may be preferably used as the binder resin. If a thermosetting resin is used as the binder resin, the resin is hardened by heating the molded product. A room-temperature setting resin or a cold setting resin may be used as the binder resin. In this case, the resin is hardened by letting the molded product stand at a room temperature or at a comparatively low temperature. A large amount of the binder resin, which is a non-magnetic material, remains in the hardened molded product. Therefore, the saturation magnetic flux density and the magnetic permeability of the hardened molded product are lower than those of the powder molded product of the internal core portion 3*i* even if the same material is used.

In addition to the powder of the magnetic material and the binder resin, the material of the couple core portion 3*o* may further include a filler made from a ceramic such as alumina or silica. While the mixture of powder of the magnetic material such as an iron-based material and the binder resin is being hardened, the powder may settle under its own weight and the density of the magnetic material in the couple core portion may become nonuniform. By mixing the filler with the material of the couple core portion, settling of the powder of the magnetic material is suppressed and the powder of the magnetic material is more likely to become uniformly dispersed in the couple core portion. If the filler is made from a ceramic, for example, heat dissipation efficiency can be increased. The proportion of the filler is, for example, in the range of 20 to 70 volume % when the volume of the couple core portion is 100%.

When using the injection molding method or the cast molding method, the magnetic permeability and the saturation magnetic flux density of the couple core portion can be adjusted by changing the ratio between the powder of the magnetic material and the binder resin, or if the filler described above is included, by changing the ratio among the powder of the magnetic material, the binder resin, and the filler. For example, the magnetic permeability tends to decrease when the proportion of the powder of the magnetic material is reduced. The magnetic permeability and the saturation magnetic flux density of the couple core portion 3*o* may be adjusted so that the reactor 1α may have a desired inductance.

Here, the couple core portion 3*o* is made from a hardened molded product composed of an epoxy resin and powder of an iron-based material including particles having an average diameter equal to or smaller than 100 μm and coated by the coating described above. The couple core portion 3*o* has a relative magnetic permeability in the range of 5 to 30 and a saturation magnetic flux density that is 0.5 T or higher and lower than that of the internal core portion. Here, B2=1 T, and the relative magnetic permeability is 10.

<<Magnetic Flux Ratio>>

As described above, in the reactor 1α, the saturation magnetic flux densities and the relative magnetic permeabilities of the internal core portion 3*i* and the couple core portion are respectively different from each other. Moreover, in the magnetic core 3α of the reactor 1α, the materials of the core portions 3*i* and 3*o* are adjusted and cross-sectional areas of the core portions 3*i* and 3*o* are set so that the magnetic flux ratio between the core portions 3*o* and 3*i* $(S1\times B1)/(S2\times B2)$ satisfies $0.17\times(B1/B2)+0.42\leqq(S1\times B1)/(S2\times B2)\leqq 0.50\times(B1/B2)+0.62$, where S1 is the cross-sectional area of the internal core portion 3*i* (the area of a circular region in FIG. 2)

when reactor 1α, is cut in a direction perpendicular to the axial direction of the coil 2α as illustrated in FIG. 1(A) (here, cut along line C-C), B1 is the saturation magnetic flux density of the internal core portion 3*i* at the cross section, S2 is the cross sectional area of the couple core portion 3*o* (the area of an annular region surrounding the coil 2α in FIG. 2), and B2 is the saturation magnetic flux density of the couple core portion 3*o* at the cross section. Here, S1=740 $mm^2$, S2=1270 $mm^2$, and (S1×B1)/(S2×B2)=1.05(0.17×1.8+0.42=0.726≦1.05≦0.50×1.8+0.62=1.52).

[Other Components]

<<Insulator>>

In order to increase insulation between the coil 2α and the magnetic core 3α, it is preferable that an insulator be disposed between the core 2α and a part of the coil 2α that may contact the core 3α. For example, insulation tape may be applied to the inner and outer peripheral surfaces of the coil 2α, or insulating paper or an insulation sheet may be disposed on the peripheral surfaces. A bobbin (not shown) made from an insulating material may be disposed on an outer periphery of the internal core portion 3*i*. The bobbin may be a cylindrical body that covers the outer periphery of the internal core portion 3*i*. By using a bobbin including an annular flange extending in the circumferential direction from both ends of the cylindrical body, insulation between the end surfaces of the coil 2α and the couple core portion 3*o* can be increased. As the material of the bobbin, an insulating resin such as a polyphenylene sulfide (PPS) resin, a liquid crystal polymer (LCP), or a polytetrafluoroethylene (PTFE) resin may be preferably used.

<<Case>>

The reactor 1α includes the case 5 for containing an assembly including the coil 2α and the magnetic core 3α. The assembly including the coil 2α and the internal core portion 3*i* is covered by a resin material that forms the couple core portion 3*o* and is sealed in the case 5. That is, the resin material of the couple core portion 3*o* also functions as a sealant for the coil 2α and the internal core portion 3*i*. In the case 5, the coil 2α is contained in such a way that the axial direction of the coil 2α is perpendicular to a surface that is located adjacent to a mount object (not shown) when the reactor 1α, is mounted on the mount object (the lower surface in FIG. 1(B)). The orientation of the coil in the case may be appropriately selected.

The material and the shape of the case may be appropriately selected. For example, the case may have a cylindrical shape that follows the shape of the assembly. Here, the case 5 is a box-shaped body that is made from a metal such as aluminium, that includes the rectangular bottom surface 50 and sidewalls 51 standing from the bottom surface 50, and that has an opening at one end thereof. In this example, the case 5 includes guide protrusions 52, a positioning portion 53, and a coil supporting portion (not shown). The guide protrusions 52, which protrude from the inner peripheral surfaces of the sidewalls 51, prevent the coil 2α from being rotated and function as guides when inserting the coil 2α. The positioning portion 53, which protrudes from a corner of the inner peripheral surface the case 5, is used to position an end of the wire 2*w*. The coil supporting portion, which is disposed on the inner peripheral surface of the case 5 and protrudes from the bottom surface 50, supports the coil 2α and determines the height of the coil 2α with respect to the case 5. By using the case 5 including the guide protrusions 52, the positioning portion 53, and the coil supporting portion, the coil 2α can be disposed at a desired position in the case 5 with a high precision, and the position of the internal core portion 3*i* with respect to the coil 2α can be determined with a high precision. Alternatively, the guide protrusions 52 and the like may be omitted; or other members may be prepared, disposed in the case, and used for positioning and the like. If the other members contained in the case are hardened molded products made from a material the same as that of the couple core portion 3*o*, the other members can be easily integrated with the couple core portion 3*o* when forming the couple core portion 3*o* and the other members can be used as a magnetic path. The case 5 in this example includes attachment portions 54 in which bolt holes 54*h* are formed. The bold holes 54*h* are used to fix the reactor 1α to a mount object (not shown) with bolts. Because the case 5 has the attachment portions 54, the reactor 1α can be easily fixed to a mount object with bolts.

[Applications]

The reactor 1α having the configuration described above can be preferably used in applications under electrical conditions such as the maximum current (direct current) in the range of about 100 A to 1000 A, the average voltage in the range of about 100 V to 1000 V, and the used frequency in the range of about 5 kHz to 100 kHz, which are typically applications as a component of a vehicle-mounted converter of an electric vehicle or a hybrid vehicle. For this application, the reactor 1α can be preferably used by adjusting the inductance when the direct current is 0 A to a value in the range of 10 μH to 1 mH, and by adjusting the inductance at the maximum current to be equal to or higher than 30% of the value when the current is 0 A.

[Size of Reactor]

The size of the reactor 1α having the configuration described above may be appropriately selected as long as the reactor 1α has a desired inductance and satisfies 0.17×(B1/B2)+0.42≦(S1×B1)/(S2×B2)≦0.50×(B1/B2)+0.62. Here, the flatness 3×L1/(L1+L2+L3) is equal to or larger than 0.5, where L1, L2, and L3 are the dimensions (illustrated in FIGS. 1 and 2), in ascending order of length, of the smallest rectangular parallelepiped that can contain the assembly including the coil 2α and the magnetic core 3α (excluding ends of the wire 2*w* of the coil 2α) (here, the flatness is 0.9). Here, the flatness of the case 5 (excluding the attachment portions 54) is equal or larger than 0.5. In this example, the volume of the reactor 1α including the case 5 is in the range of about 0.2 liter (200 $cm^3$) to 0.8 liter (800 $cm^3$) (here, 280 $cm^3$). Because the size of the reactor 1α satisfies these conditions, the reactor 1α, is small and can be preferably used as a vehicle component.

[Method of Manufacturing Reactor]

The reactor 1α can be manufactured, for example, as follows. First, the coil 2α and the internal core portion 3*i* made from a powder molded product are prepared. As illustrated in FIG. 3, an assembly including the coil 2α and the internal core portion 3*i* is made by inserting the internal core portion 3*i* into the coil 2α. An insulator may be appropriately disposed between the coil 2α and the internal core portion 3*i* as described above.

Next, the assembly is placed in the case 5. The assembly can be precisely disposed at a predetermined position in the case 5 by using the guide protrusions 52 and the like. A mixture fluid including a magnetic material and a binder resin, which will form the couple core portion 3*o* (FIG. 1), is appropriately poured into the case 5; the couple core portion 3*o* having a predetermined shape is formed; and the reactor 1α (FIG. 1) is obtained by hardening the binder resin.

[Advantages]

In the reactor 1α, the saturation magnetic flux density of the internal core portion 3*i* is higher than that of the couple core portion 3*o*. Therefore, as compared with the case where the saturation magnetic flux density of the entirety of the magnetic core is uniform, the same amount of magnetic flux can be obtained even if the internal core portion 3*i* has a smaller cross sectional area (of a surface through which the magnetic flux passes). Moreover, the reactor 1α satisfies $0.17\times(B1/B2)+0.42\leqq(S1\times B1)/(S2\times B2)\leqq 0.50\times(B1/B2)+0.62$, that is, the saturation magnetic fluxes of the core portions 3*i* and are adjusted so that the reactor 1α may have a smaller volume. Because the internal core portion 3*i* is small and the saturation magnetic fluxes of the core portions 3*i* and 3*o* satisfy the specific relationship, the size of the magnetic core 3α can be reduced and thereby the size of the reactor 1α can be reduced. Moreover, the saturation magnetic flux density of the internal core portion 3*i*, in which the coil 2α is disposed, is high, and the magnetic permeability of the couple core portion 3*o*, which covers the outer periphery of the coil 2α, is low. Therefore, a gap member can be omitted, and the reactor 1α is small also in this respect. Furthermore, in the reactor 1α, no gap member exists in the entirety of the magnetic core 3α. Therefore, the coil 2α is not influenced by leakage flux from a gap, so that the outer peripheral surface of the internal core portion 3*i* and the inner peripheral surface of the coil 2α can be disposed close to each other. Therefore, a space between the outer peripheral surface of the internal core portion 3*i* and the inner peripheral surface of the coil 2α can be reduced, and the reactor 1α is small also for this reason. In particular, because the internal core portion 3*i* is a powder molded product, and the outer shape of the internal core portion 3*i* has a cylindrical shape that follows the shape of the inner peripheral surface of the coil 2α, the size of the space can be reduced further. In addition, the reactor 1α is small also because the reactor 1α is a so-called pot-shaped reactor including only a single coil 2α.

Because the reactor 1α has an adhesiveless structure that is manufactured without using an adhesive at all and the internal core portion 3*i* can be formed without performing a step of joining a gap member, the reactor 1α has a high productivity. In particular, the reactor 1α can be manufactured by forming the magnetic core 3α by joining the internal core portion 3*i* and the couple core portion 3*o* to each other through the resin material of the couple core portion 3*o* simultaneously with forming the couple core portion 3*o*. Therefore, the reactor 1α can be manufactured with a small number of steps, and the reactor 1α has a high productivity also in this respect. Moreover, because the internal core portion 3*i* of the reactor 1α is a powder molded product, the saturation magnetic flux density of the internal core portion 3*i* can be easily adjusted and a complex three-dimensional shape can be easily formed, so that the reactor 1α has a high productivity also in this respect.

Because the reactor 1α includes the case 5, the assembly including the coil 2α and the magnetic core 3α can be protected against the external environment such as dust and corrosion and can be protected mechanically. Moreover, because the couple core portion 3*o* includes a resin component, the coil 2α and the internal core portion 3*i* can be protected against the external environment and can be mechanically protected even if the case 5 is open. Furthermore, because the entirety of the coil 2α is covered by the couple core portion 3*o* in the reactor 1α, the couple core portion 3*o* can be easily formed and the coil 2 can be sufficiently protected. In addition, because the case 5 is made from a metal, the case 5 can be used as a heat dissipation path, and thereby the reactor 1α has a high heat dissipation efficiency. In particular, because the internal core portion 3*i*, in which the coil 2α is disposed, is in contact with the case 5, heat can be efficiently dissipated from the coil 2α.

Second Embodiment

Figure 4:
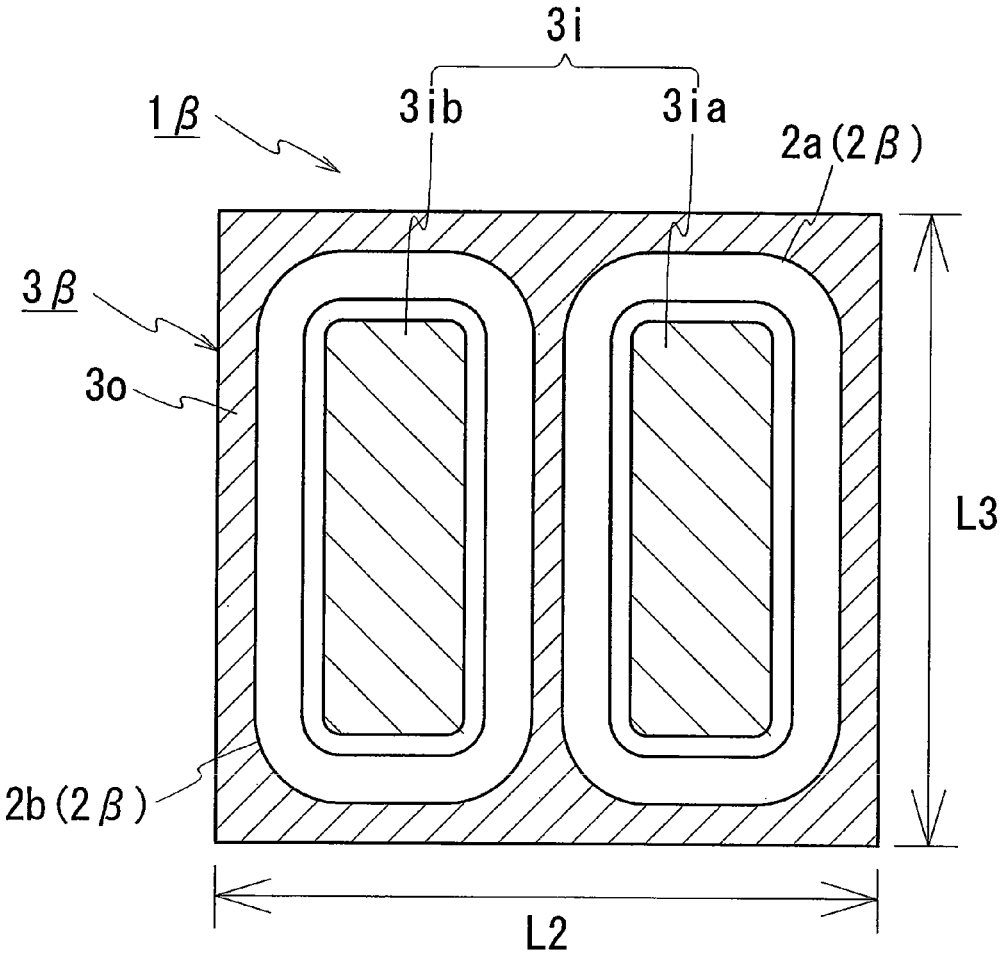
FIG. 4 schematically illustrates a reactor according to a second embodiment.
Figure 5:
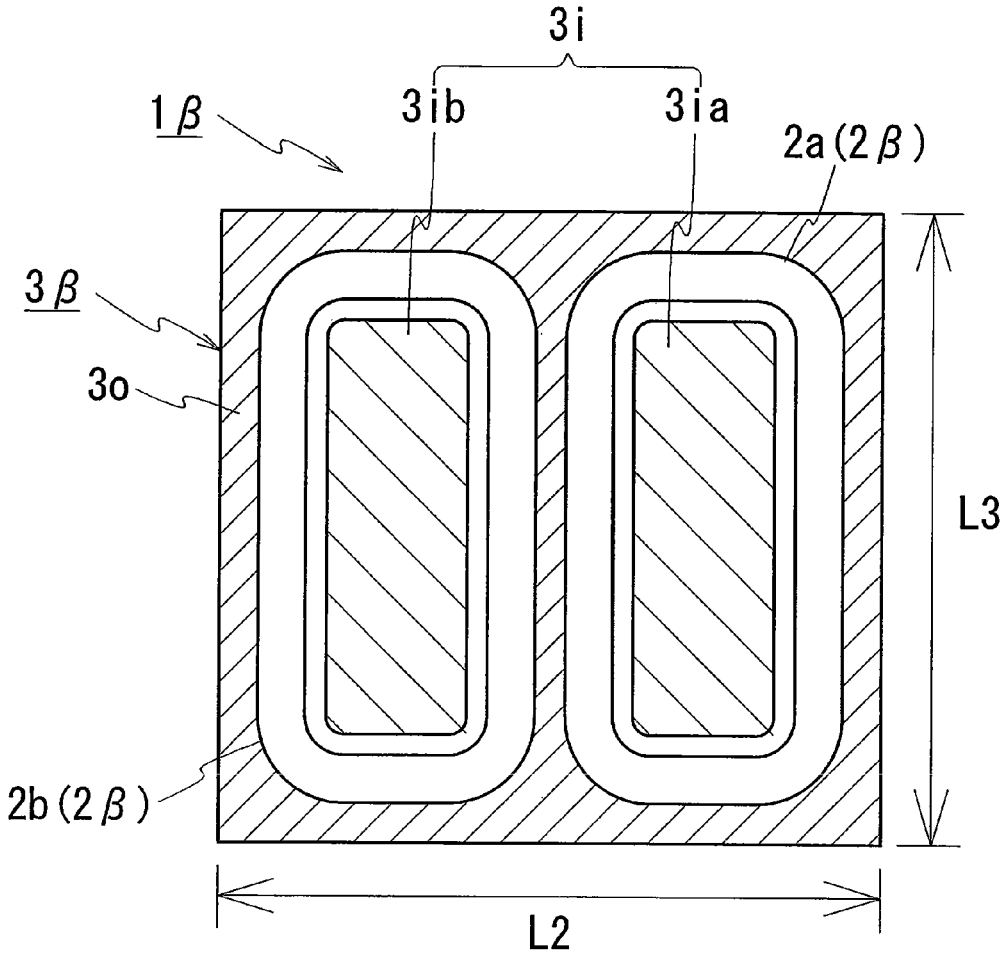
FIG. 5 is a sectional view of the reactor according to the second embodiment taken along line D-D of FIG. 4(A).

Referring mainly to FIGS. 4 and 5, a reactor 1β according to a second embodiment will be described. The basic configuration of the reactor 1β is the same as that of the reactor 1α according to the first embodiment. The reactor 1β includes the coil 2β and the magnetic core 3β. The magnetic core 3β includes the internal core portion 3*i* and the couple core portion 3*o*, and these core portions form a closed magnetic path. The internal core portion 3*i* and the couple core portion 3*o* have different magnetic characteristics. In particular, the reactor 1β differs from the reactor 1α according to the first embodiment in the following respects: the coil 2β includes a pair of coil elements 2*a* and 2*b*, a case is not provided, and the coil 2β is oriented in a different direction with respect to a surface facing a direction in which the reactor 1β is mounted. Hereinafter, mainly the differences and the advantages due to these differences will be described, and description of the configurations and advantages the same as those of the first embodiment will be omitted.

[Coil 2β]

Figure 6:
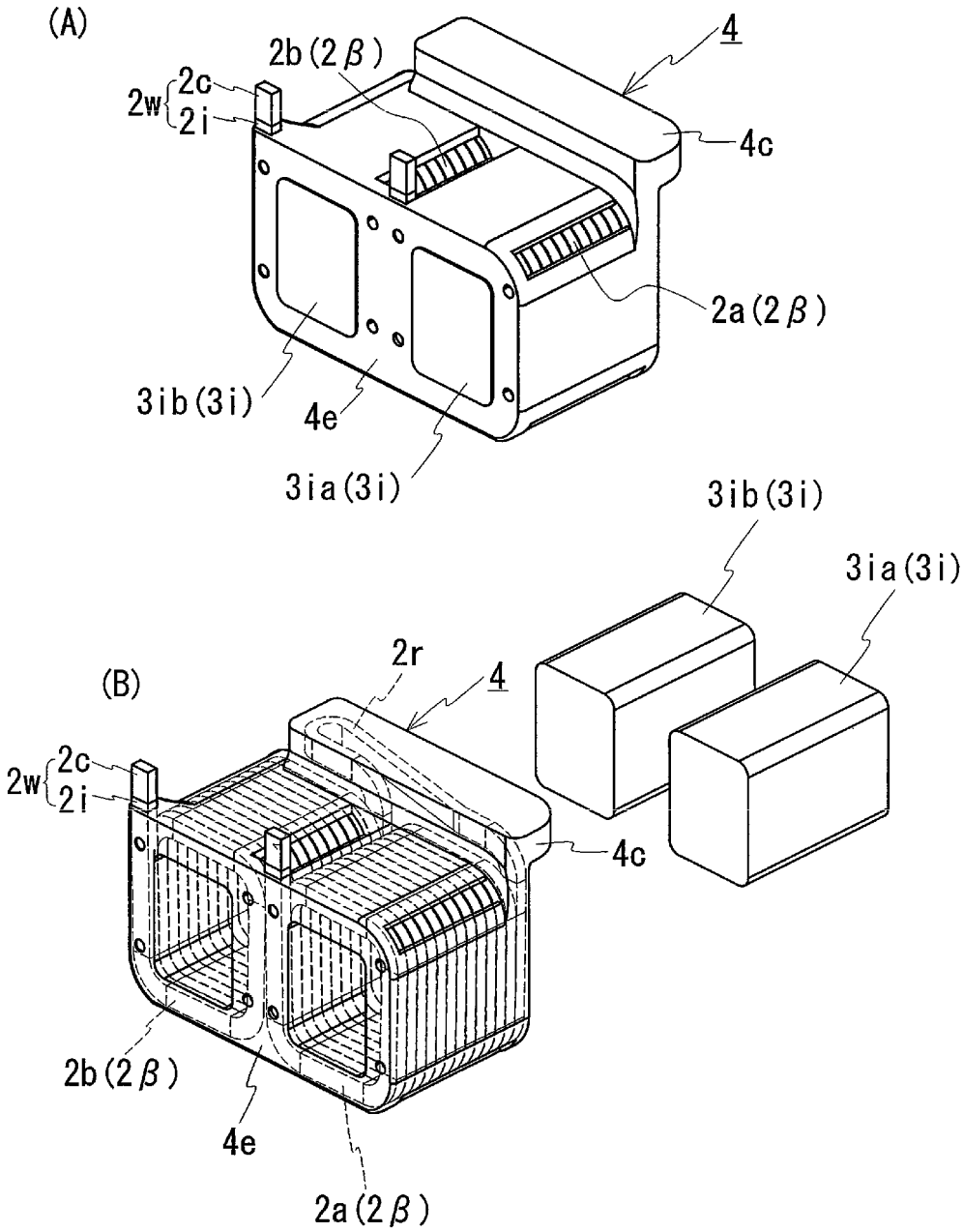
FIG. 6 schematically illustrates a coil molded product of a reactor according to a third embodiment.

The coil 2β includes the pair of coil elements 2*a* and 2*b*, which are formed by helically winding a single continuous wire 2*w* (see FIG. 6 described below). The coil elements 2*a* and 2*b* are arranged side by side so that the axial directions thereof are parallel to each other. The wire 2*w* is an insulated rectangular wire the same as that of the first embodiment (a rectangular wire having an aspect ratio that is equal to or higher than 10). The coil elements 2*a* and 2*b* are formed by winding the insulated rectangular wire edgewise, and are coupled to each other via a turn-around portion 2*r* (see FIG. 6(B)) that is formed by bending a part of the wire 2*w*. End surfaces of each of the coil elements 2*a* and 2*b* have a rectangular shape with rounded corners (racetrack shape). Here, the sum of the number of turns of the coil elements 2*a* and 2*b* is in the range of 30 to 60. (The numbers of turns in FIGS. 4 and 6 are examples.)

The coil elements may be made from different wires, and ends of the wires may be joined to each other by welding or the like to form an integrated coil. Examples of the welding method include, for example, TIG welding, laser welding, and resistance welding. Alternatively, ends of the wires may be joined to each other by crimping, cold welding, vibration welding, or the like. This configuration of the coil can be applied to other embodiments described below.

When the reactor 1β is mounted on a mount object, the coil elements 2*a* and 2*b* are disposed so that the axial directions of the coil elements 2*a* and 2*b* are parallel to a surface of the reactor 1β adjacent to the mount object.

[Magnetic Core 3β]

The magnetic core 3β includes internal core portions 3*ia* and 3*ib* and a couple core portion 3*o*. The internal core portions 3*ia* and 3*ib* are inserted through the coil elements 2*a* and 2*b*. The couple core portion 3*o* couples the internal core portions 3*ia* and 3*ib* to each other and forms a closed magnetic path jointly with the internal core portion 3*i*.

Each of the internal core portions 3*ia* and 3*ib* is has an outer shape that follows the shape of the inner peripheral surface of corresponding one of the coil elements 2*a* and 2*b*. End surfaces of each of the internal core portions 3*ia* and 3*ib* has a rectangular shape with rounded corners (racetrack shape). The entirety of each of the internal core portions 3*ia* and 3*ib* is a solid body made from a powder molded product that does not include a gap member, an air gap, and an adhesive. The internal core portion 3*i* in the second embodiment is a powder molded product made from a material the same as that of the first embodiment, and has magnetic characteristics the same as those of the reactor 1α according to the first embodiment. That is, the saturation magnetic flux density B1 is equal to or higher than 1.6 T ($1.6\ T\leqq B1$) and equal to or higher than 1.2 times the saturation magnetic flux density B2 of the couple core portion 3*o* ($1.2\times B2 \leqq B1$, $1<1.2\leqq(B1/B2)$), and the relative magnetic permeability is in the range of 100 to 500. In the example illustrated in FIG. 4, the length of each of the internal core portions 3*ia* and 3*ib* in the axial direction of the coil elements 2*a* and 2*b* (hereinafter, simply referred to as the length) is larger than the length of the coil elements 2*a* and 2*b*, and the ends of the internal core portions 3*ia* and 3*ib* protrude further than the ends surfaces of the coil elements 2*a* and 2*b*. The reactor 1β is differs from that of the first embodiment in that the protruding lengths of the ends surfaces of the internal core portions 3*ia* and 3*ib* are the same.

As illustrated in FIG. 4(A), the couple core portion 3*o* covers substantially the entire outer periphery of the assembly including the coil 2β and the internal core portion 3*i* inserted through the coil 2β. That is, the couple core portion 3*o* covers the entire outer periphery of the coil 2β, the end surfaces of the coil 2β, and the end surfaces of the internal core portion 3*i*. The couple core portion 3*o* and the internal core portion 3*i* are joined to each other without using an adhesive but through the resin material of the couple core portion 3*o*. The magnetic core 3β is an integrated body the entirety of which is integrated without using an adhesive or a gap member. The couple core portion 3*o* in the second embodiment is a hardened molded product made from a material the same as that of the reactor 1α according to the first embodiment, and has the magnetic characteristics the same as those of the first embodiment. That is, the relative magnetic permeability is in the range of 5 to 30, and the saturation magnetic flux density is equal to or higher than 0.5 T and lower than that of the internal core portion.

Here, the couple core portion 3*o* is a rectangular parallelepiped that covers the entirety of the coil 2β. However, as described above, at least a part of the outer periphery of the coil 1β may be exposed to the outside without being covered by the couple core portion as long as a closed magnetic path can be formed. Examples of such a configuration, in which a part of the outer periphery of the coil is covered by the couple core portion, include an E-E type formed by combining E-shaped cores. The examples also include a configuration in which the outer periphery of the pair of coil elements is not substantially covered by the couple core portion and is exposed to the outside. A magnetic core having this configuration is, for example, an O-shaped magnetic core in which a couple core portion is disposed so as to couple one ends and the other ends of a pair of internal core portions respectively to each other. In this configuration, the couple core portion may be formed in a state in which the coil elements have been disposed on the internal core portion. Alternatively, an O-shaped magnetic core may be made beforehand, and the coil elements may be formed at positions at which the saturation magnetic flux density is high.

The magnetic core 3β of the reactor 1β is configured as follows. The cross-sectional areas of the internal core portions 3*ia* and 3*ib* when the reactor 1β is cut along a line perpendicular to the axial direction of the coil elements 2*a* and 2*b* as illustrated in FIG. 4(A) (here, along line D-D) are the same (see FIG. 5). The materials of the core portions 3*i* and 3*o* are adjusted and cross-sectional areas of the core portions 3*i* and 3*o* are set so that the magnetic flux ratio between the core portions 3*o* and 3*i* ($S1\beta\times B1\beta/(S2\beta\times B2\beta)$) satisfies $0.17\times(B1\beta/B2\beta)+0.42\leqq(S1\beta\times B1\beta)/(S2\beta\times B2\beta)\leqq 0.50\times(B1\beta/B2\beta)+0.62$, where S1β is the cross-sectional area of one of the internal core portions, B1β is the saturation magnetic flux density of the internal core portion at the cross section, S2β is the cross-sectional area of the couple core portion 3*o* (here, the cross-sectional area of a region x of the couple core portion 3*o* that covers the end surfaces of the internal core portions 3*ia* and 3*ib* when the region x is cut in the axial direction of the coil elements 2*a* and 2*b*, which is a hatched region in FIG. 4(A)), and B2β is the saturation magnetic flux density of the couple core portion 3*o* at the cross section. Here, $(B1\beta/B2\beta)=1.8$, and $(S1\beta\times B1\beta)/(S2\beta\times B2\beta)=1.05$.

[Other Components]

<<Attachment Portion>>

The outer shape of the reactor 1β, which does not have a case, is formed by the couple core portion 3*o*. Because the couple core portion 3*o* includes a resin component, a three-dimensional outer shape can be easily formed by using a mold having an appropriate shape. For example, when mounting the reactor 1β on a mount object such as a cooling base with a fastener such as a bolt, a portion in which a bolt accommodating hole is formed (attachment portion) may be integrated with the couple core portion 3*o*. Examples of the attachment portion include a flange portion (not shown) that protrudes from a surface of the rectangular parallelepiped couple core portion 3*o* illustrated in FIG. 4(A) and that has the bolt accommodating hole. When such an attachment portion is integrated formed with the couple core portion 3*o*, it is not necessary to prepare another member such as a stay, so that the number of components can be reduced. By integrally forming the attachment portion with the couple core portion 3*o*, it is not necessary to additionally perform a step of forming the attachment portion.

The shape of the reactor 1β is a rectangular parallelepiped having a flatness $3\times L1/(L1+L2+L3)$ that is equal to or larger than 0.5, where L1, L2, and L3 (illustrated in FIGS. 4 and 5) are the dimensions of the rectangular parallelepiped in ascending order of length. The reactor 1β has a small volume in the range of about 0.2 liter (200 $cm^3$) to 0.8 liter (800 $cm^3$). Therefore, as with the reactor 1α according to the first embodiment, the reactor 1β can be preferably used as a vehicle component.

[Method of Manufacturing Reactor]

The reactor 1β can be manufactured as follows. First, the coil 2β, the internal core portion 3*i* made from a powder molded product are prepared, and the internal core portions 3*ia* and 3*ib* are respectively inserted into the coil elements 2*a* and 2*b*. As described in the first embodiment, insulation between the coil 2β and the internal core portion 3*i* may be increased by interposing an insulator therebetween. The assembly including the coil 2β and the internal core portion 3*i* is placed in a mold (not shown). A mixture fluid including a magnetic material and a binder resin, which will form the couple core portion 3*o*, is appropriately poured into the mold, thereby forming the couple core portion 3*o* having a desired shape. Then, the binder resin is hardened to obtain the reactor 1β.

Because the reactor 1β according to the second embodiment does not have a case, the number of components is small and the size is smaller than that of a reactor having a case. Because the reactor 1β includes the plurality of coil elements 2*a* and 2*b*, the length of the coil elements in the axial direction can be reduced. Therefore, a reactor having a large number of turns and having a small size can be obtained.

Third Embodiment

Referring mainly to FIG. 6, a reactor according to a third embodiment will be described. In the configurations of the first and second embodiments, the coil and the magnetic core are insulated from each other by an insulation coating 2*i* of the wire 2*w* and an insulator that is independently prepared. The reactor according to the third embodiment differs from the reactor 1β according to the second embodiment in that the reactor includes an internal resin portion 4*c* that covers the surface of the coil 2β. Hereinafter, the difference and the advantages due to the difference will be mainly described, and description of the configurations and advantages that same as those of the second embodiment will be omitted.

The reactor according to the third embodiment includes a coil molded product 4 in which the coil 2β and the internal core portion 3*i* are integrated with each other through the resin material of the internal resin portion 4*c*.

[Coil Molded Product]

The coil molded product 4 includes the coil 2β, the internal core portion 3*i* inserted through the coil 2β, and the internal resin portion 4*c*. The internal resin portion 4*c* covers the surface of the coil 2β, retains the shape of the coil 2β, and integrally retains the coil 2β with the internal core portion 3*i*.

<<Coil>>

As in the second embodiment, the coil 2β includes the pair of coil elements 2*a* and 2*b* and the turn-around portion 2*r*. The coil elements 2*a* and 2*b* are formed by winding the wire 2*w*, which is an insulated rectangular wire, edgewise and are arranged in parallel with each other. The turn-around portion 2*r* couples the coil elements 2*a* and 2*b* to each other.

<<Internal Core Portion>>

As illustrated in FIG. 6(A), the internal core portions 3*ia* and 3*ib* are inserted through the coil elements 2*a* and 2*b*, respectively. The internal core portion 3*i* is integrated with the coil 2β with the resin material of the internal resin portion 4*c* in a state in which the internal core portions 3*ia* and 3*ib* are inserted into the coil elements 2*a* and 2*b*. As with the reactor 1β according to the second embodiment, the internal core portion 3*i* has a rectangular parallelepiped shape with rounded corners. The length of the internal core portion 3*i* (the length of the coil 2β in the axial direction) is adjusted so that the end surfaces slightly protrude from end surfaces 4*e* of the internal resin portion 4*c*.

<<Internal Resin Portion>>

The internal resin portion 4*c* covers substantially the entirety of the coil 2β in such a way that both ends of the wire 2*w* and parts of the outer periphery of the coil elements 2*a* and 2*b* (here, corners of the coil elements 2*a* and 2*b*) are exposed to the outside. The exposed portions that are in the parts of the outer periphery of the coil elements 2*a* and 2*b* are the portions at which the coil 2β was directly held by a mold when the internal resin portion 4*c* was formed. Instead of the corner portions of the coil 213, the portions at which the coil 2β is held by the mold may be any portions, such as flat portions formed by turns of the coil 2β.

Because parts of the coil 2β are not covered by the internal resin portion 4*c* but are exposed to the outside, the outer shape of the internal resin portion 4*c* is a shape having protrusions and recesses. To increase insulation between the coil 2β and the couple core portion 3*o*, it is preferable that recessed grooves in the internal resin portion 4*c*, from which parts of the coil 2β are exposed, be covered by an insulator. For example, insulating tape may be applied to the grooves or the grooves may be filled with additional insulation resin.

Portions of the internal resin portion 4*c* that cover the turn portions of the coil elements 2*a* and 2*b* have a substantially uniform thickness. A portion of the internal resin portion 4*c* that covers the turn-around portion 2*r* has a larger thickness and protrudes in the axial direction of the coil 2β. The thickness of the internal resin portion 4*c* can be appropriately selected so that the internal resin portion 4*c* may have desired insulation characteristics. For example, the thickness is in the range of about 1 to 10 mm.

The internal resin portion 4*c* also has a function of retaining the coil elements 2*a* and 2*b* in a state in which the coil elements 2*a* and 2*b* are compressed relative to their free lengths.

A material that can be preferably used as the resin material of the internal resin portion 4*c* is a material that has heat resistance to the extent that the material does not soften at the highest possible temperature that the coil or the core may reach while the reactor including the coil molded product 4 is used and that can be subjected to transfer molding and injection molding. For example, a thermosetting resin such an epoxy resin, a PPS resin, or a thermoplastic resin such as LCP can be preferably used. Here, an epoxy resin is used. When filler made from at least one of ceramics selected from silicon nitride, alumina, aluminium nitride, boron nitride, and silicon carbide is mixed with the resin material of the internal resin portion 4*c*, heat can be easily dissipated from the coil and a reactor having a high heat dissipation efficiency can be obtained.

<<Method of Manufacturing Coil Molded Product>>

The coil molded product 4 can be manufactured by using a mold (not shown) described below. This mold includes a pair of first and second molds that are openable and closable. The first mold includes an end plate that is positioned adjacent to one end of the coil 2β (near the ends of the wire 2*w* that are drawn out in FIG. 6). The second mold includes an end plate that is positioned adjacent to the other end of the coil (near the turn-around portion 2*r* in FIG. 6) and sidewalls that cover the periphery of the coil 2β.

The first and second molds include a plurality of rod-like elements that can be moved back and forth in the mold using a drive mechanism. The rod-like elements appropriately press end surfaces of the coil elements 2*a* and 2*b* (surfaces where the turns look annular), and thereby compresses the coil elements 2*a* and 2*b* and retains the coil 2β at a predetermined position in the mold. The rod-like elements have a sufficient strength for compressing the coil 2β and a sufficiently high heat resistance against heat that is applied to the rod-liken elements when molding the internal resin portion 4*c* and the like. It is preferable that the thickness of each rod-like element be as small as possible so that the number of portions of the coil 2β that are not covered by the internal resin portion 4*c* (holes in the end surfaces of the coil elements 2*a* and 2*b* in FIG. 6) may be reduced. The mold includes a retention member that holds the corner portions of the coil 2β.

The coil 2β is placed in the mold. To be specific, the coil 2β and the internal core portion 3*i* are coaxially disposed so that predetermined spaces are formed between the inner peripheral surfaces of the coil elements 2*a* and 2*b* and the outer peripheral surfaces of the internal core portions 3*ia* and 3*ib*. The coil 2β is placed in the mold so that predetermined spaces are formed between the inner peripheral surface of the mold and the outer peripheral surfaces of the coil elements 2*a* and 2*b*. The internal core portion 3*i* can be positioned in the mold by positioning the internal core portion 3*i* with respect to an end plate of the mold. When the coil 2β is placed in the mold, the coil 2β has not been compressed.

Next, the mold is closed, and the coil elements 2*a* and 2*b* are compressed by inserting the rod-like elements into the mold. Due to this compression, spaces between adjacent turns of each of the coil elements 2*a* and 2*b* are reduced. This compression is performed while holding the corner portions of the coil 2β by using the retention member. Alternatively, another member that is capable of retaining the coil 2β in a predetermined shape may be attached to the coil 2β, and the compressed coil 2β may be placed in the mold. After the coil 2β has been placed in the mold, the position of the coil 2β can be stably retained in the mold by retaining the coil elements 2*a* and 2*b* in a compressed state by, for example, removing the other member while pressing the coil elements 2*a* and 2*b* by using the rod-like element, fitting a part of the other member into a recessed groove in the mold, or fixing the other member with a bolt or the like. It is preferable that the other member have a removable configuration and thereby be reusable.

Subsequently, resin is injected into the mold from a resin injection hole, the resin is hardened, the rod-like elements and the like are extracted, the mold is opened, and the coil molded product 4 is taken out of the mold. In the coil molded product 4, the coil 2β is retained in a predetermined shape by being compressed by the internal resin portion 4*c*, and the internal core portion 3*i* is integrated. Small holes are formed in portions that have been pressed by the rod-like elements. To increase insulation between the coil 2β and the couple core portion 3*o*, it is preferable that the holes be closed by filling the holes with an insulation resin or applying insulating tape to the holes. Basic parts of the method of manufacturing the coil molded product 4 described above can be applied to a coil molded product according to a fourth embodiment described below.

[Method of Manufacturing Reactor]

A reactor including the coil molded product 4 can be manufactured by first making the coil molded product 4 as described above; placing the coil molded product 4 in a mold (not shown); pouring a mixture fluid including a magnetic material and a binder resin, which will form the couple core portion, into the mold; and molding and hardening the mixture.

[Advantages]

In the reactor according to the third embodiment, the coil 2β and the internal core portion 3*i* are integrated with each other through the internal resin portion 4*c*. Therefore, substantially only the resin material of the internal resin portion 4*c* exists in the space between the inner peripheral surface of the coil 2β and the outer peripheral surface of the internal core portion 3*i*, and the material of the couple core portion does not exist in the space. As a result, the reactor is small. Because the reactor according to the third embodiment also includes the internal core portion 3*i*, which has a rectangular parallelepiped shape with rounded corners, the space described above can be further reduced. Moreover, because the resin material of the internal resin portion 4*c* exists in the space, the coil 2β and the internal core portion 3*i* can be more reliably insulated from each other.

In the reactor according to the third embodiment, as with the reactors 1α and 1β according to the first and second embodiments, adhesive is not used, the magnetic core and the reactor can be formed simultaneously with forming the couple core portion 3*o*, and the coil molded product 4 that retains the shape of the coil 2β is used. Therefore, the coil 2β can be handled easily when manufacturing the reactor, and thereby the reactor has a high productivity. Because the internal core portion 3*i* is integrally included in the coil molded product 4, it is not necessary to insert the internal core portion 3*i* into the coil 2β. Therefore, the number of production steps can be reduced, and the reactor has a high productivity also in this respect. Moreover, because the coil 2β and the internal core portion 3*i* can be handled as a unit, as compared with the case where these members are independent members, the coil 2β and the internal core portion 3*i* can be easily placed in a mold when forming the couple core portion 3*o*. Therefore, the reactor has a high productivity also in this respect.

In addition, because the coil molded product 4 retains the coil 2β in a compressed state, the length of the coil 2β in the axial direction can be reduced, and the size of the reactor can be reduced also in this respect.

In the third embodiment, a coil molded product contains a coil including a plurality of coil elements. Alternatively, the coil molded product may include only one coil as with the coil 2α in the first embodiment. In this case, because the coil molded product contains only one coil and the turn-around portion 2*r* (FIG. 6(B)) is not present, the coil molded product can be easily formed and has a high productivity.

Fourth Embodiment

In the third embodiment, the coil molded product 4 is configured so that the coil 2β and the internal core portion 3*i* are integrated with each other through the internal resin portion 4*c*. Alternatively, the coil molded product may be configured so that the internal core portion and the coil are not integrated with each other through the internal resin portion, that is, so that the coil molded product is constituted by the coil and the internal resin portion. This coil molded product has hollow bores formed by a resin material of an internal resin portion that covers the inner peripheries of the coil elements. An internal core portion is inserted through each of the hollow bores. The thickness of the resin material of the internal resin portion is adjusted and the shape of the hollow bore is formed so as to follow the outer shape of the internal core portion so that each internal core portion can be disposed at an appropriate position on the inner periphery of each coil element. Thus, the resin material of the internal resin portion on the inner periphery of each coil element can function as a positioning portion for each internal core portion.

Such a coil molded product can be manufactured by disposing a core having a predetermined shape instead of the internal core portion in the process of manufacturing the coil molded product 4, which has been described in the third embodiment. A reactor including such a coil molded product can be manufactured by inserting the internal core portions through the hollow bores in the obtained coil molded product, placing an assembly including the coil molded product and the internal core portion in a mold, and forming the couple core portion.

Fifth Embodiment

The assembly including the coil and the magnetic core described in the second to fourth embodiments can be used as it is. The reactor may include a case described in the first embodiment, and the reactor may include an external resin portion (not shown) that covers at least a part of the outer periphery of the assembly. Substantially the entire outer periphery of the assembly may be covered by an external resin portion, or a part of the assembly may be exposed to the outside. As the material of the external resin portion, an epoxy resin, a urethane resin, a PPS resin, a polybutylene terephthalate (PBT) resin, an acrylonitrile butadiene styrene (ABS) resin, an unsaturated polyester, or a mixture of any of these resins and filler made from ceramics described above may be used. The heat dissipation efficiency of the resin may be increased by adding ceramic filler described above. In particular, it is preferable that external resin portion have a high heat dissipation efficiency with a thermal conductivity coefficient that is 0.5 W/m·K or larger, more preferably 1.0 W/m·K or larger, and in particular, 2.0 W/m·K or larger.

The reactor including the external resin portion can protect against the external environment and mechanically protect not only the coil and the internal core portion but also the couple core portion. If the reactor includes the external resin portion, both ends of the wire of the coil are exposed from the external resin portion so that terminal members can be attached to the ends. If the reactor includes the attachment portion described above, the attachment portion may be integrally formed with the external resin portion, may be formed on both the external resin portion and the couple core portion, or may be formed only on the couple core portion.

Sixth Embodiment

As a modification of the reactor 1α having the case, which has been described in the first embodiment, for example, the reactor may be formed by, as with the second embodiment, preparing an assembly including the coil 2α and the magnetic core 3α, placing the assembly in the case, and filling the case with a potting resin that has been additionally prepared. As the potting resin, for example, a resin the same as that of the external resin portion may be used. When filling the case with the potting resin, both ends of the wire of the coil are exposed from the potting resin so that the terminal members can be attached. With the potting resin, the coil and the entirety of the magnetic core including the couple core portion can be more effectively protected against the external environment.

Seventh Embodiment

In the embodiments described above, the internal core portion 3*i* is made from a powder molded product. Alternatively, a laminated structure including magnetic steel plates, which are typically silicon steel plates, may be used as the internal core portion. When the magnetic steel plates are used, a magnetic core having a saturation magnetic flux density higher than that of a powder molded product can be easily obtained.

Examples

A magnetic core for a reactor including portions having different magnetic characteristics was used as a test sample, and the relationship between the saturation magnetic fluxes of these portions and the volume of the reactor was obtained by performing a simulation. Test conditions were as follows.

(1) The magnetic permeability of the internal core portion was fixed at 250, and the magnetic permeability of the couple core portion was fixed at 10.

(2) The saturation magnetic flux density was set so that the average saturation magnetic flux densities of the internal core portion and the couple core portion was 1.4 T.

(3) The saturation magnetic flux density ratio B1/B2 was selected from the range of 1 to 2.5.

(4) The magnetic flux ratio (S1×B1)/(S2×B2) was selected from the range of 0.5 to 1.8.

(5) The shape of the magnetic core (typically a substantially cubic shape) was selected so as to minimize the volume of the magnetic core under the conditions such that the magnetic core satisfied, when B1/B2 and (S1×B1)/(S2×B2) were each set, if the electric current was 150 A, the inductance L was equal to or higher than 200 μH, if the electric current was 300 A, the inductance L was equal to or higher than 100 μH, and the electrical resistance (direct current) Rdc was equal to or lower than 20 mΩ.

(6) The basic shape of the magnetic core was a coaxial configuration described in the first embodiment, in which substantially the entire periphery of the internal core portion was covered by the couple core portion.

(7) All magnetic fluxes generated in the coil passed through the internal core portion and the couple core portion, and there was no leakage flux.

The range of B1/B2 was set with consideration of a possible range of B1/B2 when the magnetic core was made from a generally-used magnetic material. The range of (S1×B1)/(S2×B2) was set around a central value when the saturation magnetic flux of the entirety of the magnetic core was uniform, i.e., around (S1×B1)/(S2×B2)=1.

In this test, for values of (B1/B2) in the range of 1 to 2.5 described above, the volume (absolute value) of the magnetic core at values of (S1×B1)/(S2×B2) in the range of 0.5 to 1.8 was calculated. Here, when the cross sectional shape of the wire of the coil and the number of turns of the coil are determined, the size and the inductance of the coil can be determined. Therefore, the number of turns of the coil, the cross-sectional shape of the wire, the cross-sectional areas S1 and S2 of the internal core portion and the couple core portion were used as variables; and a combination of the variables that satisfies the inductance and the electrical resistance in the condition (5) described above and that minimizes the volume (absolute value) was used to calculate the volume of the magnetic core. The minimum volume for each value of (B1/B2) and for the values of (S1×B1)/(S2×B2) in the range of 0.5 to 1.8 was used as the reference volume (=1) for the value of (B1/B2), and the volume divided by the reference volume was defined as the relative volume. Table I shows the relative volume. FIG. 7(I) illustrates the relationship between (S1×B1)/(S2×B2) and the relative volume.

TABLE I

| | B1/B2 | | | | | |
|---|---|---|---|---|---|---|
| S1 × B1/S2 × B2 | 1 | 1.2 | 1.5 | 1.8 | 2 | 2.5 |
| 0.5 | 1.44 | 1.66 | — | — | — | — |
| 0.6 | 1.14 | 1.29 | 1.46 | — | — | — |
| 0.7 | 1.01 | 1.07 | 1.18 | 1.29 | 1.35 | 1.54 |
| 0.8 | 1 | 1 | 1.05 | 1.10 | 1.14 | 1.26 |
| 0.9 | 1.05 | 1.03 | 1 | 1.01 | 1.03 | 1.11 |
| 1 | 1.13 | 1.08 | 1.02 | 1 | 1 | 1.02 |
| 1.1 | 1.19 | 1.14 | 1.07 | 1.01 | 1 | 1 |
| 1.2 | 1.25 | 1.21 | 1.11 | 1.06 | 1.03 | 1.01 |
| 1.3 | 1.33 | 1.27 | 1.17 | 1.09 | 1.07 | 1.03 |
| 1.4 | 1.40 | 1.32 | 1.22 | 1.13 | 1.10 | 1.06 |
| 1.5 | 1.47 | 1.39 | 1.29 | 1.19 | 1.14 | 1.09 |
| 1.8 | — | — | — | 1.31 | 1.26 | 1.19 |

As illustrated in FIG. 7(I), the larger the value of B1/B2, i.e., the larger the difference between the saturation magnetic flux density B1 of the internal core portion and the saturation magnetic flux density B2 of the couple core portion, the relative volume is smaller, i.e., the size of the magnetic core can be reduced when the value of the magnetic flux ratio (S1×B1)/(S2×B2) is larger. The volume is not necessarily small when 1<B1/B2 and the value of (S1×B1)/(S2×B2) is 1.

It is assumed that, if a reactor having a certain volume (for example, 300 $cm^3$ or smaller) is required, the acceptable upper limit is 1.2 times the certain volume. Therefore, for the relative volume smaller than 1.2, the relationship between (B1/B2) and (S1×B1)/(S2×B2) was examined. Here, for the relative volume equal to or smaller than 1.2, the maximum value and the minimum value of (S1×B1)/(S2×B2) corresponding to a value of (B1/B2) was examined. The result is shown in Table II and FIG. 7(II).

TABLE II

| B1 | B2 | B1/B2 | (S1 × B1)/(S2 × B2) min | (S1 × B1)/(S2 × B2) max |
|---|---|---|---|---|
| 1.4 | 1.4 | 1 | 0.57 | 1.12 |
| 1.53 | 1.27 | 1.2 | 0.63 | 1.2 |
| 1.68 | 1.12 | 1.5 | 0.69 | 1.37 |
| 1.8 | 1 | 1.8 | 0.74 | 1.54 |
| 1.87 | 0.93 | 2 | 0.77 | 1.66 |
| 2 | 0.8 | 2.5 | 0.83 | 1.84 |

Figure 7:
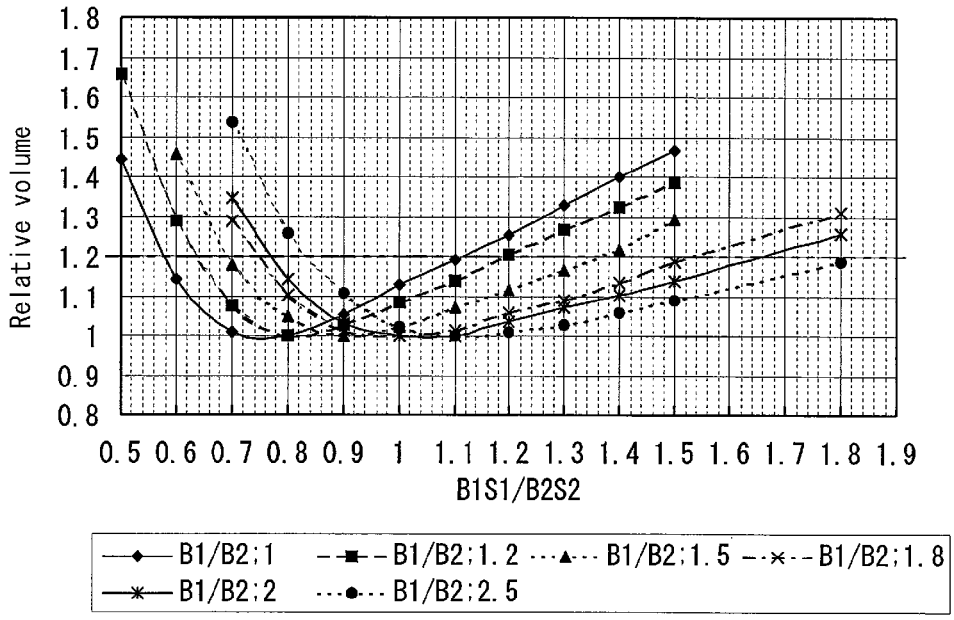
FIG. 7(I) is a graph illustrating the relationship between the magnetic flux ratio (S1×B1)/(S2×B2) and the relative volume, and FIG. 7(II) is a graph illustrating the relationship between the saturation magnetic flux density ratio (B1/B2) and the magnetic flux ratio (S1×B1)/(S2×B2).
Figure 7:
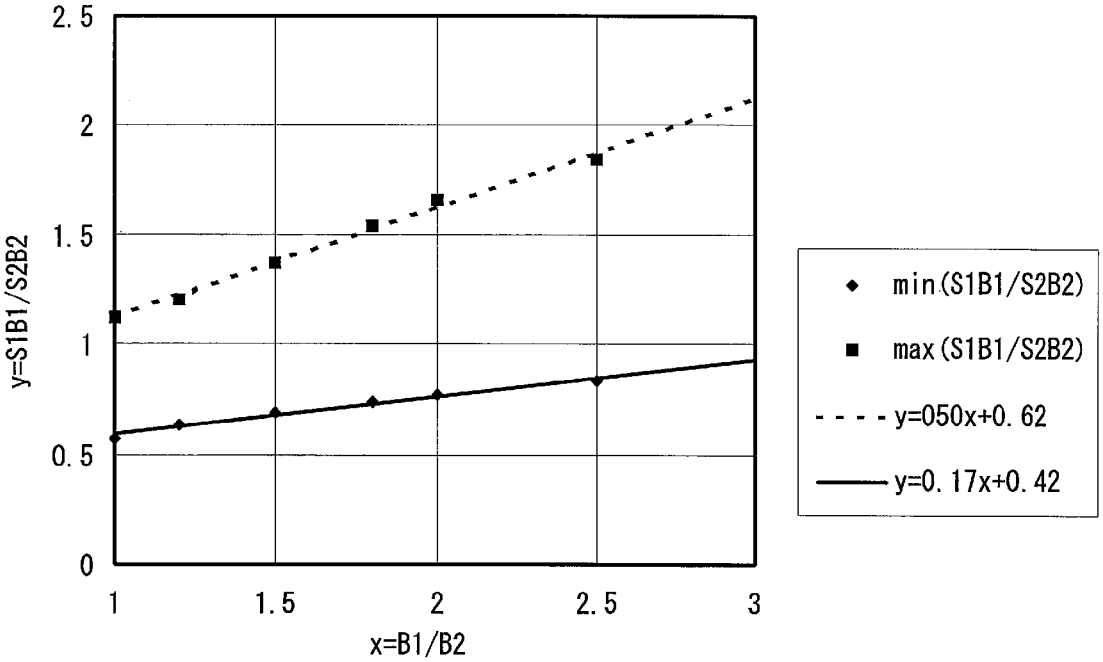

As illustrated in FIG. 7(II), both the minimum value and the maximum value of (S1×B1)/(S2×B2) can be approximated by linear functions of (B1/B2). By approximating the minimum value and the maximum value by using linear functions (y=ax+b), where x is (B1/B2) and y is (S1×B1)/(S2×B2), an approximation equation y=0.17x+0.42 for the minimum value and an approximation equation y=0.50x+0.62 for the maximum value are obtained. On the basis of these approximation equations, it is found that, by selecting y=(S1×B1)/(S2×B2) that satisfies 0.17x+0.42≦y≦0.50x+0.62, the magnetic core can satisfy the condition that the relative volume is equal to or smaller than 1.2. Therefore, it is found that the size of the reactor can be reduced when the reactor satisfies 1<(B1/B2) and 0.17×(B1/B2)+0.42≦(S1×B1)/(S2×B2)≦0.50×(B1/B2)+0.62.

The embodiments described above can be appropriately modified within the scope of the present invention, and are not limited to the configuration described above.

INDUSTRIAL APPLICABILITY

The reactor according to the present invention can be used as a component of an electric power converter, such as a bidirectional DC-DC converter, that is mounted in a vehicle such as a hybrid vehicle, an electric vehicle, or a fuel-cell vehicle.

REFERENCE SIGNS LIST

1α, 1β reactor
2α, 2β coil
2*w* wire
2*c* conductor
2*i* insulation coating
2*a*, 2*b* coil element
2*r* turn-around portion
3α, 3β magnetic core
3*i*, 3*ia*, 3*ib* internal core portion
3*o* couple core portion
4 coil molded product
4*c* internal resin portion
4*e* end surface
5 case
50 bottom surface
51 sidewall
52 guide protrusion
53 positioning portion
54 attachment portion
54*h* bolt accommodating hole

The invention claimed is:

1. A reactor comprising a coil and a magnetic core, the coil being formed by winding a wire, the magnetic core including an internal core portion that is inserted through the coil and a couple core portion that covers at least a part of an outer periphery of the coil, the core portions forming a closed magnetic path, wherein 1<(B1/B2) and 0.17×(B1/B2)+0.42≦(S1×B1)/(S2×B2)≦0.50×(B1/B2)+0.62 are satisfied, where S1 is a cross-sectional area of the internal core portion, B1 is a saturation magnetic flux density of the internal core portion, S2 is a cross-sectional area of the couple core portion, B2 is a saturation magnetic flux density of the couple core portion, (B1/B2) is a saturation magnetic flux density ratio between the core portions, and (S1×B1)/(S2×B2) is a magnetic flux ratio between the core portions.

2. The reactor according to claim 1, wherein the couple core portion has a magnetic permeability lower than that of the internal core portion, and the couple core portion is made from a mixture of a magnetic material and a resin, and wherein the internal core portion and the couple core portion are integrated with each other through the resin.

3. The reactor according to claim 1, wherein the number of the coils formed by winding the wire is one.

4. The reactor according to claim 1, wherein the internal core portion is made from a powder molded product, and wherein the couple core portion is made from a mixture of an iron-based material and a resin.

5. The reactor according to claim 1, further comprising an internal resin portion that is made from an insulating resin, that covers a surface of the coil, and that retains a shape of the coil.

6. The reactor according to claim 1, wherein the wire has a flat shape with a cross section having an aspect ratio that is equal to or higher than 5, and wherein the number of turns of the coil is in the range of 30 to 60.

7. The reactor according to claim 1, wherein a flatness 3×L1/(L1+L2+L3) of the smallest rectangular parallelepiped that is capable of containing an assembly including the coil and the magnetic core is equal to or larger than 0.5, where L1, L2, and L3 are dimensions of the rectangular parallelepiped in ascending order of length.

8. The reactor according to claim 1, wherein the saturation magnetic flux density B1 of the internal core portion satisfies 1.6 T≦B1 and 1.2×B2≦B1.

9. The reactor according to claim 1, wherein a magnetic permeability of the internal core portion is in the range of 50 to 1000, and wherein a magnetic permeability of the couple core portion is in the range of 5 to 50.

10. The reactor according to claim 1, further comprising an external resin portion that covers at least a part of an outer periphery of an assembly including the coil and the magnetic core.

11. The reactor according to claim 1, further comprising a case that contains an assembly including the coil and the magnetic core, wherein the couple core portion is made from a mixture of a magnetic material and a resin, and wherein the coil and the internal core portion are sealed in the case by the resin included in the couple core portion.

12. The reactor according to claim 1, wherein the couple core portion includes an attachment portion for fixing the reactor to a mount object.

13. The reactor according to claim 5, wherein the internal core portion is retained by the internal resin portion so as to be integrated with the coil.

14. The reactor according to claim 1, wherein the internal core portion is made from a laminated structure of magnetic steel plates.

15. The reactor according to claim 1, wherein (B1/B2) ≧1.5.

* * * * *